US009902586B2

(12) United States Patent
Iida

(10) Patent No.: US 9,902,586 B2
(45) Date of Patent: Feb. 27, 2018

(54) SHEET PROCESSING APPARATUS CAPABLE OF CREATING FOLD SECTION, METHOD OF CONTROLLING THE SAME, AND STORAGE MEDIUM

(71) Applicant: CANON KABUSHIKI KAISHA, Tokyo (JP)

(72) Inventor: Toshihiko Iida, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 851 days.

(21) Appl. No.: 13/924,739

(22) Filed: Jun. 24, 2013

(65) Prior Publication Data

US 2014/0005022 A1 Jan. 2, 2014

(30) Foreign Application Priority Data

Jun. 27, 2012 (JP) ..... 2012-144340

(51) Int. Cl.
*B65H 45/00* (2006.01)
*B65H 37/06* (2006.01)
(Continued)

(52) U.S. Cl.
CPC ..... *B65H 45/00* (2013.01); *B65H 37/04* (2013.01); *B65H 37/06* (2013.01); *B65H 45/18* (2013.01); *B65H 45/28* (2013.01); *B65H 2801/27* (2013.01)

(58) Field of Classification Search
CPC ..... B65H 37/04; B65H 37/06; B65H 45/02; B65H 45/04; B65H 45/06; B65H 45/08; B65H 45/09; B65H 2301/4505
(Continued)

(56) References Cited

U.S. PATENT DOCUMENTS 5,382,011 A * 1/1995 Tani ..... G03G 15/6541 270/37
5,443,437 A * 8/1995 Mack ..... B65H 45/168 493/359

(Continued)

FOREIGN PATENT DOCUMENTS

CN 101436010 A 5/2009
CN 102413255 A 4/2012

(Continued)

OTHER PUBLICATIONS

Office Action issued in CN201310261915.3, dated Jul. 3, 2015. English translation provided.

(Continued)

*Primary Examiner* — Stephen F Gerrity
*Assistant Examiner* — Joshua Kotis
(74) *Attorney, Agent, or Firm* — Rossi, Kimms, & McDowell LLP

(57) ABSTRACT

A sheet processing apparatus capable of creating fold sections suitable for an apparatus that performs saddle-stitch processing on fold sections. A sheet processing apparatus includes a printer engine configured to form an image on a recording sheet. The sheet processing apparatus sets a bookbinding lap which is a distance between a first sheet end and a second sheet end of the recording sheet assumed to have been folded in two. A finisher creates the fold section by forming a folding line on recording sheets according to a reference line which is shifted from the centerline of the recording sheet by the bookbinding lap.

8 Claims, 24 Drawing Sheets

(51) Int. Cl.
*B65H 37/04* (2006.01)
*B65H 45/18* (2006.01)
*B65H 45/28* (2006.01)

(58) Field of Classification Search
USPC ..... 493/405, 444; 270/32, 51, 58.07, 58.08, 270/58.09; 358/1.18
See application file for complete search history.

(56) References Cited

U.S. PATENT DOCUMENTS

| | | | | |
|---|---|---|---|---|
| 5,461,469 | A * | 10/1995 | Farrell | G03G 15/6541 270/37 |
| 6,224,529 | B1 * | 5/2001 | Honmochi | B42C 1/12 493/320 |
| 6,606,944 | B1 | 8/2003 | Athans et al. | |
| 6,825,949 | B1 * | 11/2004 | Hirai | G03G 15/5095 270/52.18 |
| 7,896,328 | B2 | 3/2011 | Kawamura et al. | |
| 8,226,076 | B2 * | 7/2012 | Shirakuma | B42C 1/10 270/32 |
| 8,472,068 | B2 | 6/2013 | Kurokawa | |
| 2002/0119877 | A1 * | 8/2002 | Jackson | B41F 13/0045 493/359 |
| 2003/0189718 | A1 * | 10/2003 | Yamamura | G06F 3/1204 358/1.13 |
| 2006/0217253 | A1 * | 9/2006 | Thoma | B65H 45/16 493/432 |
| 2007/0045921 | A1 * | 3/2007 | Suzuki | B65H 45/18 270/37 |
| 2009/0121407 | A1 * | 5/2009 | Kawamura | G03G 15/6538 270/32 |
| 2011/0084436 | A1 * | 4/2011 | Shirakuma | B42C 1/10 270/37 |
| 2012/0069403 | A1 * | 3/2012 | Kurokawa | H04N 1/38 358/1.18 |

FOREIGN PATENT DOCUMENTS

| | | | |
|---|---|---|---|
| JP | 04363299 | A | 12/1992 |
| JP | 2001-206626 | A | 7/2001 |
| JP | 2002205873 | A | 7/2002 |
| JP | 2003305970 | A | 10/2003 |
| JP | 2007193193 | A | 8/2007 |
| JP | 2009269746 | A | 11/2009 |
| JP | 2012027117 | A | 2/2012 |

OTHER PUBLICATIONS

Office Action issued in Japanese Appln. No. 2012-144340 dated May 10, 2016.
English translation of Official Action issued in Japanese Appln. No. 2012-144340 dated May 10, 2016 (JP Office Action originally submitted in May 23, 2016 IDS).

* cited by examiner

100
CONTROLLER UNIT
101
CPU
102
RAM
103
ROM
104
HDD
105
IMAGE BUS I/F
106
CONSOLE SECTION I/F
107
NETWORK I/F
108
ACCESSORY I/F
109
FINISHER
110 SYSTEM BUS
111 IMAGE BUS
112
RIP
113
DEVICE I/F
114
IMAGE-EDITING IMAGE PROCESSING SECTION
115
IMAGE EXPANSION SECTION
116
IMAGE COMPRESSION SECTION
117
SCANNER IMAGE PROCESSING SECTION
118
PRINTER IMAGE PROCESSING SECTION
119
SCANNER
120
PRINTER ENGINE
121
CONSOLE SECTION
122
LAN

SHEET PROCESSING APPARATUS CAPABLE OF CREATING FOLD SECTION, METHOD OF CONTROLLING THE SAME, AND STORAGE MEDIUM

BACKGROUND OF THE INVENTION

Field of the Invention

The present invention relates to a sheet processing apparatus, a method of controlling the same, and a storage medium.

Description of the Related Art

In conventional sheet processing apparatuses, during production of saddle-stitched books, a folding position for center-fold processing is sometimes displaced from the center of a sheet. The displacement of the folding position from the middle of a sheet is caused e.g. by an assembly error of a sheet processing apparatus, variation in sheets between production lots of the sheets, and a change in sheets due to changes in environmental conditions, such as humidity and temperature.

To cope with this, conventionally, several copies are printed for test printing before final production of saddle-stitched books so as to check whether or not a folding position is at an expected position. Then, if the folding position is displaced from the expected position, fine adjustment is performed physically or by software such that the folding position is arranged at the expected position.

In relation to this, there has been proposed a sheet processing apparatus that is capable of correcting displacement of a folding position within approximately ±1 mm, by providing two setting items for adjusting the folding position and the stitched position such that they are accurately arranged in the middle of each sheet during production of saddle-stitched books (see e.g. Japanese Patent Laid-Open Publication No. 2001-206626).

The two setting items are an item which can be set only by a service technician for correcting the above-mentioned displacement due to an assembly error, and an item which can be set by a user for correcting displacement due to a sheet.

This makes it possible to prevent the position on which saddle-stitch processing and center-fold processing are performed from being displaced from the middle of a sheet.

For production of saddle-stitched books, in some cases, processing operations up to center-fold processing are performed by a sheet processing apparatus, and subsequent processing operations including saddle-stitch processing are performed using another sheet processing apparatus (off-line apparatus) which is different from the above-mentioned sheet processing apparatus. Further, the off-line apparatuses include one configured to feed sheets one by one by pinching an extending portion (portion of a sheet, which does not overlap when being folded) of an end of a sheet with rollers. In the off-line apparatus of this type, if a sheet is folded in the middle, an extending portion of an end of the sheet is not generated, and as a result, the off-line apparatus cannot accurately feed the sheet (fold section, i.e. signature).

A production method in which saddle-stitch processing and processing steps thereafter are performed using an off-line apparatus is generally determined from the viewpoint of productivity, based on related factors, such as a difference in the number of sheets which can be bound, a level of the accuracy of binding, and a level of speed at which the off-line apparatus can perform processing.

When producing saddle-stitched books using the above-mentioned production method, a print product generated by the sheet processing apparatus is required to have a center-folding position shifted from the center of a sheet by a predetermined length.

The sheet processing apparatus disclosed in Japanese Patent Laid-Open Publication No. 2001-206626 is capable of performing fine adjustment for correcting the displacement of a folding position from the center of a sheet, caused by the above-mentioned assembly error, and displacement of a folding position from the center of a sheet, caused by the above-mentioned variation in sheets.

On the other hand, the sheet processing apparatus disclosed in Japanese Patent Laid-Open Publication No. 2001-206626 does not take into consideration shifting of a folding position from the center of a sheet, and further, is not capable of performing adjustment large enough to create a fold section, a fore edge of which is generally required to have a length of 5 mm to 10 mm, demanded by the above-mentioned production method.

Further, when shifting a folding position from the center of a sheet, it is necessary to adjust the position of an image to be printed on the sheet in accordance with the adjustment of the folding position. In the sheet processing apparatus disclosed in Japanese Patent Laid-Open Publication No. 2001-206626, however, the image position adjustment is not taken into consideration.

SUMMARY OF THE INVENTION

The present invention provides a sheet processing apparatus that is capable of creating fold sections which are suitable for an apparatus that performs saddle-stitch processing on fold sections, a method of controlling the sheet processing apparatus, and a storage medium.

In a first aspect of the present invention, there is provided a sheet processing apparatus capable of performing folding processing on sheets, comprising a receiving unit configured to receive a distance between a first sheet end and a second sheet end of each sheet assumed to have been folded in two, and a control unit configured to control folding of the sheet such that the distance between the first sheet end and the second sheet end becomes the distance received by the receiving unit.

In a second aspect of the present invention, there is provided a method of controlling a sheet processing apparatus capable of performing folding processing on sheets, comprising receiving a distance between a first sheet end and a second sheet end of each sheet assumed to have been folded in two, and controlling folding of the sheet such that the distance between the first sheet end and the second sheet end becomes the received distance.

In a third aspect of the present invention, there is provided a non-transitory computer-readable storage device storing a computer-executable program for causing a computer to execute a method of controlling a sheet processing apparatus capable of performing folding processing on sheets, wherein the method comprises receiving a distance between a first sheet end and a second sheet end of each sheet assumed to have been folded in two, and controlling folding of the sheet such that the distance between the first sheet end and the second sheet end becomes the received distance.

According to the present invention, it is possible to provide a sheet processing apparatus that is capable of creating fold sections suitable for an apparatus that performs saddle-stitch processing on fold sections, a method of controlling the same, and a storage medium.

Further features of the present invention will become apparent from the following description of exemplary embodiments with reference to the attached drawings.

DESCRIPTION OF THE EMBODIMENTS

The present invention will now be described in detail below with reference to the accompanying drawings showing embodiments thereof.

Figure 1:
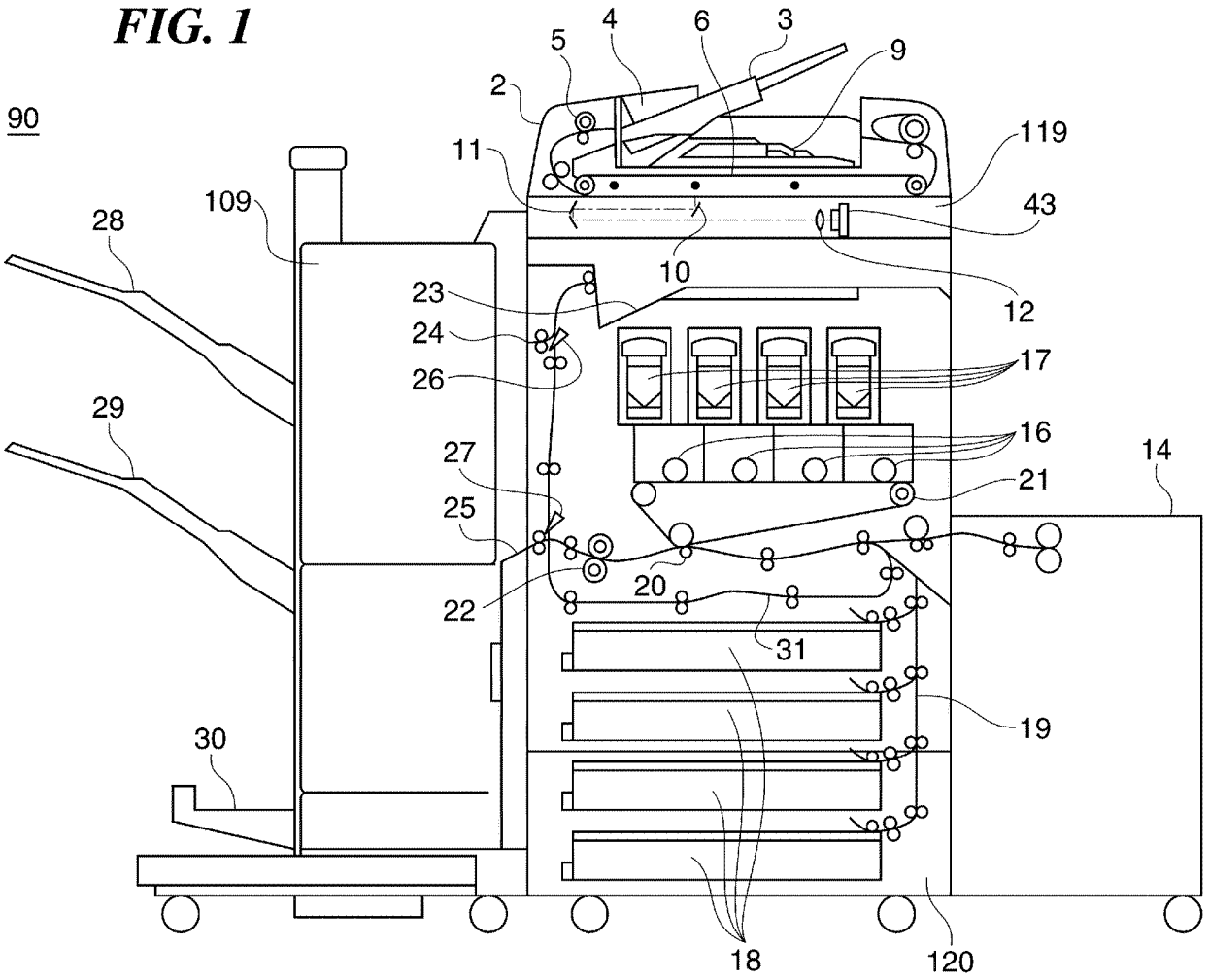
FIG. 1 is a diagram showing the mechanical configuration of a sheet processing apparatus according to a first embodiment of the present invention.

FIG. 1 is a diagram showing the mechanical configuration of a sheet processing apparatus 90 according to a first embodiment of the present invention.

In the present embodiment, a multifunction peripheral having functions of a copy machine, a printer, a facsimile machine, and so forth will be described as an example of the sheet processing apparatus 90. However, the sheet processing apparatus 90 may be a single-function apparatus.

In FIG. 1, the sheet processing apparatus 90 includes a scanner 119, a document feeder (DF) 2, a printer engine 120 including drums for four colors, a sheet feeding deck 14, and a finisher 109.

First, a scan operation performed mainly by the scanner 119 will be described.

When the scan operation is performed by setting an original on an original platen glass, not shown, a user sets the original on the original platen glass, and closes the document feeder 2. When an opening/closing sensor, not shown, detects that the document feeder 2 has been closed, a reflective original size detection sensor, not shown, disposed within a casing of the scanner 119 detects the size of the set original.

Upon detection of the original size, a light source 10 irradiates the original with light, and reflected light enters a CCD 43 through a reflective plate 11 and a lens 12. The CCD 43 converts the light having entered therein to a digital signal, and sends the converted signal to a controller unit 100 (see FIG. 8) of the scanner 119.

The controller unit 100 performs desired image processing on the received digital signal, converts the processed signal to a laser recording signal, and stores the laser recording signal in a memory (RAM 102: see FIG. 8) provided therein as image data.

When an original is read by setting the original on the document feeder 2, the user places the original on a tray of an original setting section 3 of the document feeder 2 in a face-up manner. When the original is placed, an original detection sensor 4 detects that the original has been set.

When the original detection sensor 4 detects that the original has been set, the controller unit 100 causes an original feeding roller 5 and a conveyance belt 6 to rotate to thereby convey the original to a predetermined position on the original platen glass.

After the original is conveyed to the predetermined position, the controller unit 100 performs the same scan operation as that performed on the original platen glass, and stores the scanned image data in the memory. Then, the controller unit 100 discharges the original having been read onto an original discharge tray 9.

If a plurality of originals are set on the document feeder 2, the controller unit 100 causes an original having been read to be discharged, and at the same time causes a next original to be fed to the original platen glass via the original feeding roller 5 to thereby perform the operation for scanning the next original. Thus, the operation for reading the plurality of originals is performed.

Next, a description will be given of a print operation performed by the printer engine 120 as an image forming unit that forms an image on a recording sheet.

A recording signal (print image data) temporarily stored in the memory within the controller unit 100 is transferred to the printer engine 120, and is converted to recording laser beams for respective colors of yellow, magenta, cyan, and black by a laser recording section.

Then, the converted recording laser beams are irradiated onto photosensitive members 16 for the respective colors to thereby form electrostatic latent images on the respective photosensitive members. Then, the electrostatic latent images are developed with toner supplied from toner cartridges 17, respectively, and the thus visualized images are primarily transferred onto an intermediate transfer belt 21 as a primary transfer image.

Then, the intermediate transfer belt 21 is rotated clockwise, and when a recording sheet fed from one of sheet feed cassettes 18 or the sheet feeding deck 14 along a sheet feeding conveying path 19 has reached a secondary transfer position 20, the primary transfer image is transferred from the intermediate transfer belt 21 onto the recording sheet.

The recording sheet having the image transferred thereon is pressed and heated by a fixing device 22 to have the toner fixed thereon, and is conveyed along a discharge conveying path. Then, the recording sheet is discharged onto a center tray 23 in a face-down manner or is switched back to a discharge outlet 24 which guides the recording sheet to the finisher 109, or is discharged onto a side tray 25 in a face-up manner.

Flappers 26 and 27 are used for switching the conveying path in order to switch these discharge outlets. In double-sided printing, the flapper 27 switches the conveying path after the recording sheet passes the fixing device 22, and then the recording sheet is switched back and conveyed downward through a double-sided printing conveying path 31 to the secondary transfer position 20 again, whereby a double-sided printing operation is achieved.

Double-sided printing circulation control is performed using the conveying paths including the double-sided printing conveying path 31, the secondary transfer position 20, and the fixing device 22. Five-sheet circulation control is performed for A-4 size sheets and LTR size sheets, and three-sheet circulation control is performed for sheets having a size larger than the A-4 and LTR sizes.

Next, a description will be given of an operation performed by the finisher 109 as a creation unit configured to create a fold section (signature). The finisher 109 performs post-processing on a sheet according to settings designated by the user. More specifically, the finisher 109 has functions of stapling (one-point stapling/two-point stapling), punching (two-hole punching/three-hole punching), and saddle-stitch processing.

The finisher 109 appearing in FIG. 1 includes discharge trays 28, 29, and 30, and a sheet having passed through the discharge outlet 24 which guides a sheet to the finisher 109 is discharged onto one of the discharge trays associated with the respective functions of copying, printing, and facsimile, according to a setting designated by the user.

When the sheet processing apparatus 90 is used as a printer, various settings, such as settings for monochrome printing, color printing, a sheet size, 2-up/4-up printing/N-up printing, double-sided printing, stapling, punching, saddle-stitching, a lining board, a cover, and a back cover, can be made using a driver.

Next, a description will be given of the construction and operation of the finisher 109 appearing in FIG. 1 with reference to FIGS. 2 to 7.

Figure 2:
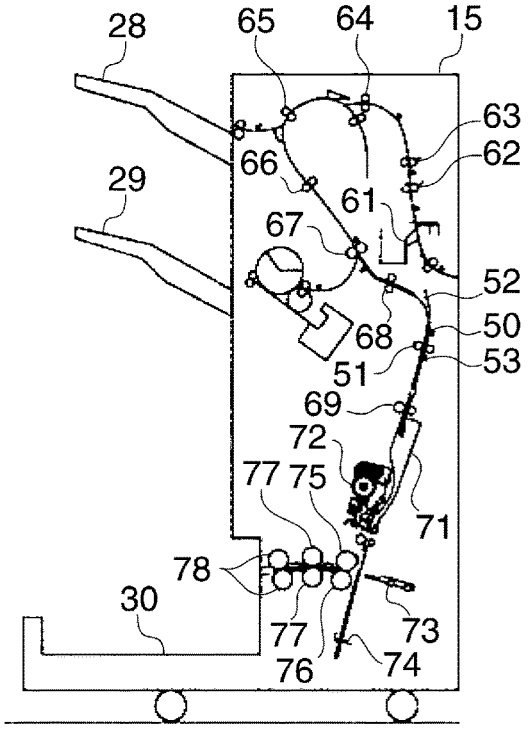
FIG. 2 is a diagram useful in explaining the construction and operation of a finisher appearing in FIG. 1.

In FIG. 2, the finisher 109 includes conveying rollers 61 to 69, leading edge detection sensors 50 and 53, a skew correction roller 51, a loop space 52, a conveying path 71, a stapler 72, a thrusting plate 73, a stopper 74, folding rollers 75 and 76, and bundle conveying roller pairs 77 and 78. Further, S denotes a sheet.

The finisher 109 may be operated according to commands from the controller unit 100 of the sheet processing apparatus 90, or may be operated by a controller unit of its own.

A sheet conveyed from the sheet processing apparatus 90 is discharged onto one of the discharge trays 28, 29, and 30 according to a type of sheet processing set by the user.

For example, when sheet processing is not executed, the sheet is discharged onto the discharge tray 28. When normal staple processing is executed, the sheet is discharged onto the discharge tray 29, and when saddle-stitch bookbinding processing or center-fold bookbinding processing is executed, the sheet is discharged onto the discharge tray 30. Note that center-fold bookbinding processing includes center-fold processing and saddle-stitch bookbinding processing includes center-fold processing and saddle-stitch processing.

Figure 3:
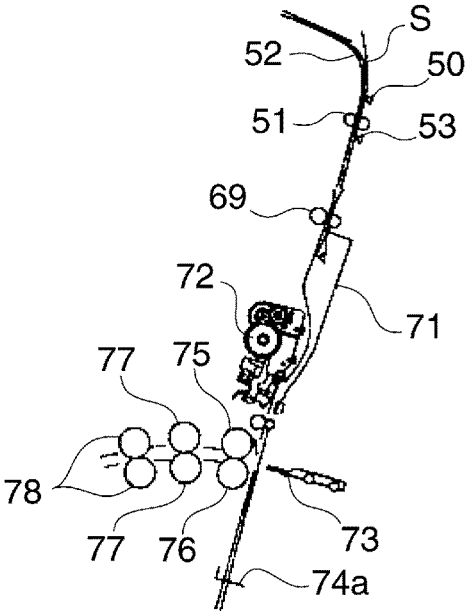
FIG. 3 is a diagram useful in explaining the construction and operation of the finisher appearing in FIG. 1.

The sheet conveyed from the sheet processing apparatus 90 is conveyed by the conveying rollers 61 to 68 until a leading edge of the sheet reaches the leading edge detection sensor 50. Then, as shown in FIG. 3, when the leading edge of the sheet is detected by the leading edge detection sensor 50, a speed of the conveying roller 68 nipping the sheet is reduced, and the leading edge of the sheet is brought into abutment with a nip of the skew correction roller 51.

Even after the leading edge of the sheet has been brought into abutment with the nip of the skew correction roller 51, the conveying roller 68 continues to be rotated for a while. Then, the sheet forms a loop or bend in the loop space 52, and then the conveying roller 68 is stopped.

Next, the skew correction roller 51 starts rotation thereof. If the sheet is skewed, the skew is corrected by the skew correction roller 51. The sheet subjected to skew correction is conveyed toward the conveying roller 69.

Figure 4:
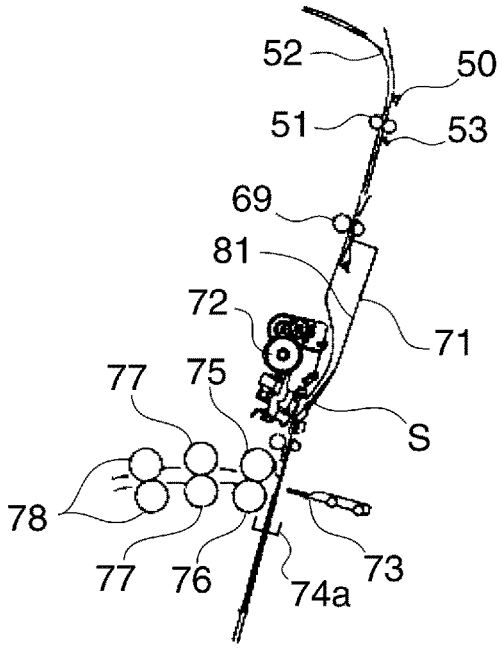
FIG. 4 is a diagram useful in explaining the construction and operation of the finisher appearing in FIG. 1.

Then, as shown in FIG. 4, the sheet is conveyed by a predetermined amount from the time point when the leading edge of the sheet is detected by the leading edge detection sensor 53, whereby the leading edge of the sheet is brought into abutment with a stopper 74*a*.

At this time, as shown in FIG. 4, the sheet is positioned by the stopper 74*a* such that a stapling position to be stapled by the stapler 72 is arranged in the center of the sheet. By repeating the above-described operation, a plurality of sheets are sequentially conveyed into the conveying path 71.

Figure 5:
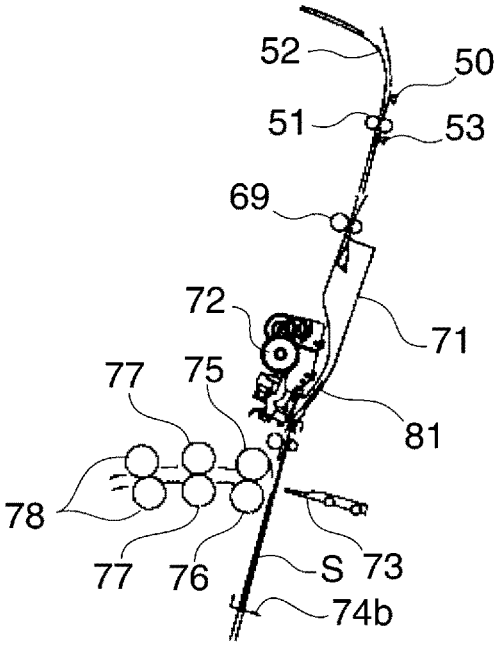
FIG. 5 is a diagram useful in explaining the construction and operation of the finisher appearing in FIG. 1.

Then, when all of sheets forming a booklet have been conveyed into the conveying path 71, these sheets are aligned in a direction of the width thereof by a width direction-aligning plate, not shown, and as shown in FIG. 5, a sheet bundle 81 is formed within the conveying path 71.

At this time, the sheets to be conveyed into the conveying path 71 are sequentially conveyed in such a manner that a sheet material to be set at the innermost location of the booklet is first conveyed, and a cover of the booklet is finally conveyed.

Further, when the settings are made such that saddle-stitch bookbinding processing is to be performed, the stapler 72 performs binding processing on the sheet bundle 81. When the sheet bundle 81 has been bound or stapled by the stapler 72, the stopper 74*a* having supported the sheet bundle 81 is moved downstream in a conveying direction, and serves as a stopper 74*b* as shown in FIG. 5.

The sheet bundle 81 is moved downstream in the conveying direction in accordance with the movement of the stopper. On the other hand, when the settings are not made such that saddle-stitch bookbinding processing is to be performed, but are made such that center-fold bookbinding processing is to be performed, the stopper is positioned at a location of the stopper 74*b* from the start of conveying the sheets, and stapling by the stapler 72 is omitted.

Figure 6:
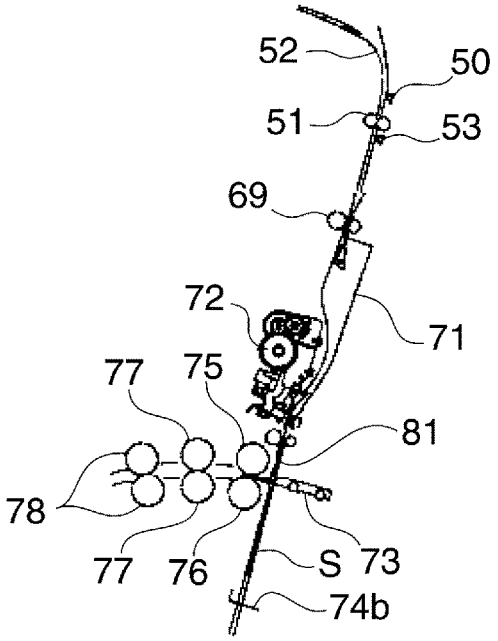
FIG. 6 is a diagram useful in explaining the construction and operation of the finisher appearing in FIG. 1.

The stopper 74*b* positions the sheet bundle 81 such that the center of the sheet bundle 81 is arranged at a location of the thrusting plate 73. Then, a front end of the thrusting plate 73 is brought into abutment with a portion of the sheet bundle 81 positioned by the stopper 74*b*, where a fold line is to be formed, and as shown in FIG. 6, the sheet bundle is thrust in a nip between the folding rollers 75 and 76 to thereby form a fold line on the sheet material.

Figure 7:
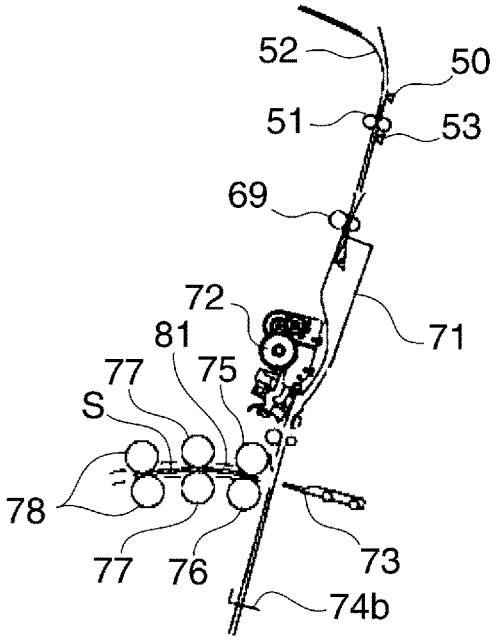
FIG. 7 is a diagram useful in explaining the construction and operation of the finisher appearing in FIG. 1.

The sheet bundle 81 folded and formed with the fold line by the folding rollers 75 and 76 is discharged onto the discharge tray 30 by the bundle conveying roller pairs 77 and 78 as shown in FIG. 7.

When conveying the folded sheet bundle 81 by the bundle conveying roller pairs 77 and 78, if binding processing (stapling) has been executed, the sheet bundle has been bound, and hence the sheet bundle is stably conveyed.

However, in a case where binding processing has not been executed, when a plurality of sheets are conveyed in a folded state, if the number of sheets is large, the sheet bundle is conveyed with lower stability than the case where binding processing has been executed. As the number of sheets included in a sheet bundle is larger, the stability of the conveyed sheets becomes lower, and a paper jam is more likely to occur due to a jam of a displaced sheet in a conveying path.

Figure 8:
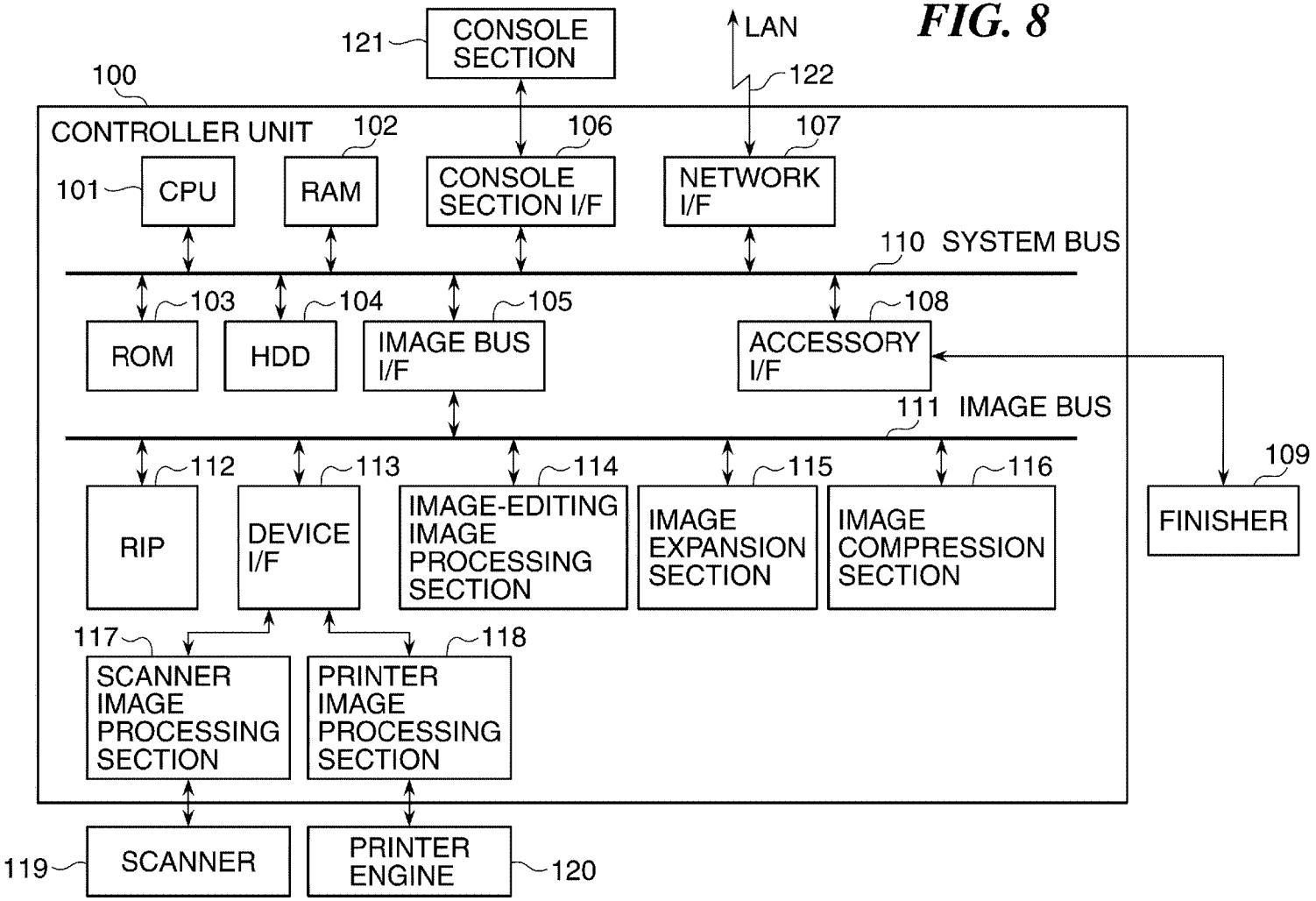
FIG. 8 is a diagram showing the electrical configuration of the sheet processing apparatus according to the first embodiment.

FIG. 8 is a diagram showing the electrical configuration of the sheet processing apparatus 90 according to the first embodiment of the present invention.

In FIG. 8, the sheet processing apparatus 90 includes the controller unit 100 that controls the overall operation of the sheet processing apparatus 90, the finisher 109 that performs post-processing, and the scanner 119 as an image input device. The sheet processing apparatus 90 further includes the printer engine 120 as an image output device, and a console section 121 used for inputting instructions from an operator and displaying information to the operator.

The finisher 109, the scanner 119, the printer engine 120, and the console section 121 are connected to the controller unit 100, and are controlled according to instructions from the controller unit 100. The scanner 119 is connected to a scanner image processing section 117 of the controller unit 100, and the printer engine 120 is connected to a printer image processing section 118 of the controller unit 100.

The controller unit 100 includes a CPU 101. The CPU 101 is connected to the RAM 102, a ROM 103, an HDD 104, an image bus interface 105, a console section interface 106, an accessory interface 108, and a network interface 107, via a system bus 110.

The RAM 102 is a memory for providing a work area for the CPU 101. The RAM 102 is used as a set value-storing memory for temporarily storing parameter setting values, and an image memory for storing part of image data.

The ROM 103 is a boot ROM which stores a system boot program. The HDD 104 stores system software, history of the parameter setting values, image data, and so on.

The CPU 101 is capable of loading the system boot program stored in the ROM 103 into the RAM 102. By thus loading the system boot program in the RAM 102, the CPU 101 becomes capable of executing a controller program.

The console section interface 106 is an interface for inputting and outputting information and data to and from the console section 121. The console section interface 106 outputs image data to be displayed to the console section 121 according to instructions from the CPU 101, and transfers information input by the operator via the console section 121 to the CPU 101.

The accessory interface 108 is connected to the finisher 109, and transfers data of a type of post-processing, set values, adjustment values, and a device status, to the finisher 109 according to instructions received from the CPU 101. The finisher 109 is a device for performing post-processing, and the types of the finisher to be connected include a stapling unit, a folding machine, and a puncher.

The network interface 107 is connected to a LAN 122, and performs inputting and outputting of information to and from the LAN 122.

The image bus interface 105 is a bus bridge that connects between the system bus 110 and an image bus 111, and converts data structure. A RIP 112 rasterizes a PDL code received from the LAN 122 into a bitmap image. An image-editing image processing section 114 performs image processing on data of original images read by the scanner 119 or stored in the HDD 104.

An image expansion section 115 decodes and expands image data stored in the HDD 104 in a compressed and encoded state before the image data is subjected to image processing by the printer image processing section 118 and is then output to the printer engine 120.

Further, an image compression section 116 encodes image data processed by the RIP 112 and the scanner image processing section 117 by a predetermined compression method before storing the same in the HDD 104.

The device interface 113 is connected to the scanner 119 and the printer engine 120 via the scanner image processing section 117 and the printer image processing section 118, respectively, and performs synchronous-to-asynchronous or asynchronous-to-synchronous conversion of image data, and transfer of data of set values, adjustment values, and a device status.

The scanner image processing section 117 performs various kinds of processing, including correction, processing, image area separation, scaling, binarization, and other editing processing, on image data input from the scanner 119.

The scanner 119 is capable of reading both sides of each of a plurality of originals as described with reference to FIG. 1. Further, as described with reference to FIG. 1, the scanner 119 includes the sensors for detecting opening/closing of the document feeder 2, presence of an original, and a size of an original. The detected information and the status information of the scanner 119 are sent to the CPU 101 via the scanner image processing section 117 and the device interface 113.

The printer image processing section 118 performs processing on image data to be printed out, such as correction and resolution conversion dependent on the printer engine 120, and adjustment of print position of an image.

Further, the sheet feed cassettes 18 described with reference to FIG. 1 each detect a size of sheets stored therein, and notifies the CPU 101 of the detected size via the printer engine 120, the printer image processing section 118, and the device interface 113.

Further, device status information indicative of the remaining amount of sheets in each sheet feed cassette 18, an opened/closed state of each cassette, etc., is sent to the CPU 101 via the printer image processing section 118 and the device interface 113.

Figure 9:
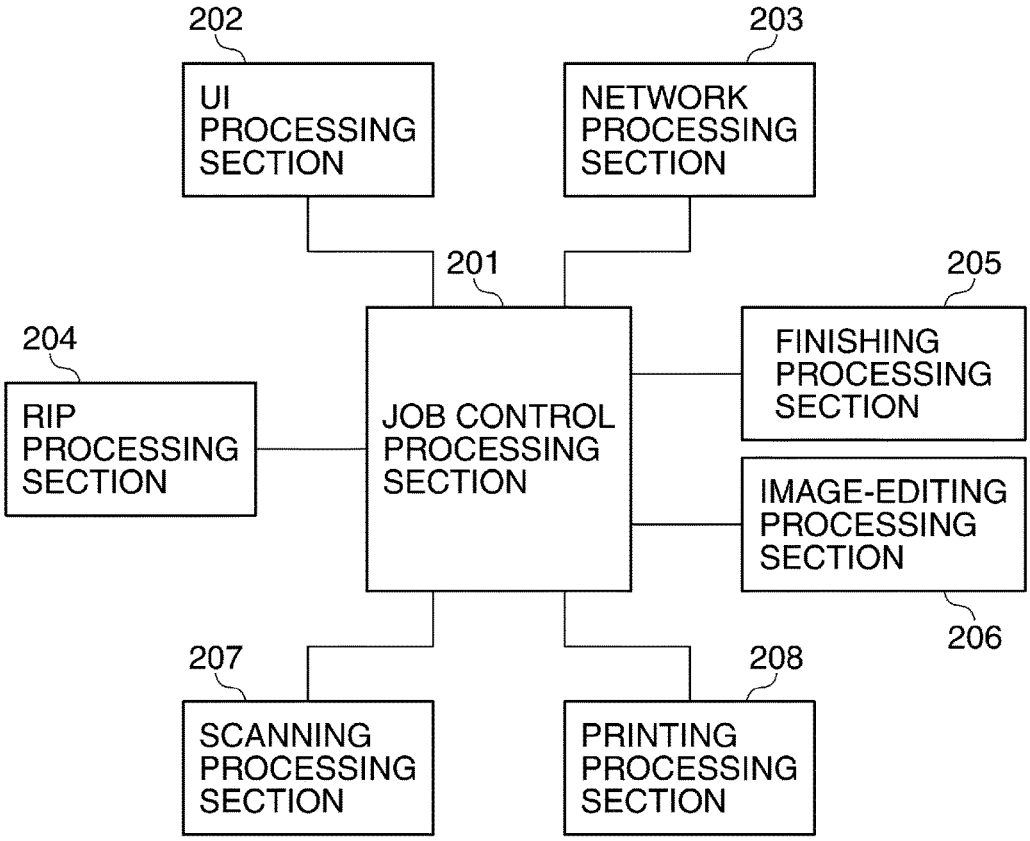
FIG. 9 is a diagram showing software module configuration of the sheet processing apparatus according to the first embodiment.

FIG. 9 is a diagram showing software module configuration of the sheet processing apparatus 90 according to the first embodiment.

The software modules shown in FIG. 9 are mainly operated on the CPU 101. A job control processing section 201 controls the software modules shown or not shown in FIG. 9, and controls every job generated in the sheet processing apparatus 90, such as a copy job, a print job, a scan job, and a user interface processing job.

An user interface processing section 202 performs control associated mainly with the console section 121 and the console section interface 106. The user interface processing section 202 notifies the job control processing section 201 of a user's operation using the console section 121, and controls contents to be displayed on a display screen of the console section 121 based on instructions from the job control processing section 201. The user interface processing section 202 further controls editing of image data to be displayed on the console section 121.

A network processing section 203 is a module for controlling external communication mainly via the network interface 107, and controls communication with the apparatuses on the LAN 122.

When the network processing section 203 receives a control command or data from each apparatus on the LAN 122, the network processing section 203 notifies the job control processing section 201 of the received contents. Further, the network processing section 203 transmits a control command or data to each apparatus on the LAN 122 based on instructions from the job control processing section 201.

A RIP processing section 204 performs interpretation of a PDL (page description language) based on instructions from the job control processing section 201, and causes the RIP 112 to perform rendering to thereby rasterize PDL data into a bitmap image.

A finishing processing section 205 controls the finisher 109 based on instructions from the job control processing section 201 to perform control of sheets and finishing processing on the sheets by the finisher 109. Further, the finishing processing section 205 acquires status information of the finisher 109, and notifies the job control processing section 201 of the acquired status information.

An image-editing processing section 206 controls the image-editing image processing section 114 based on instructions from the job control processing section 201 to thereby perform image processing on a designated image.

The image-editing processing section 206 receives image data, and image information indicative of a size, a color mode, and resolution of the image data, from the job control processing section 201. Then, the image-editing processing section 206 controls the image-editing image processing section 114, the image expansion section 115, and the image compression section 116, to thereby perform proper image processing on the image data, and notifies the job control processing section 201 of the processed image.

A scanning processing section 207 controls the scanner 119 and the scanner image processing section 117 based on instructions from the job control processing section 201 to thereby read an original set on the scanner 119.

Then, the scanning processing section 207 instructs the scanner image processing section 117 to perform image processing on the read original image. Further, the scanning processing section 207 acquires status information of the scanner image processing section 117 and the scanner 119, and notifies the job control processing section 201 of the acquired information.

A printing processing section 208 controls the image-editing image processing section 114, the printer image processing section 118, and the printer engine 120, based on instructions from the job control processing section 201, to thereby perform printing processing on a designated image.

The printing processing section 208 receives image data, and information, such as the above-mentioned image information, layout information, and output sheet information, from the job control processing section 201. The layout information is information indicative of offset, scaling, imposition, and so on. Further, the output sheet information is information indicative of a size, a printing direction, and so on.

Then, the printing processing section 208 controls the image expansion section 115, the image compression section 116, the image-editing image processing section 114, and the printer image processing section 118, to thereby perform proper image processing on the image data, and controls the printer engine 120 to thereby print the processed image data on a printing sheet.

The printing processing section 208 controls the printer image processing section 118 and the printer engine 120 to thereby perform printing on a printing sheet. Further, the printing processing section 208 acquires status information of the printer image processing section 118 and the printer engine 120, and notifies the job control processing section 201 of the acquired information.

FIGS. 10A to 10F are schematic diagrams of screens which are displayed on the console section 121 appearing in FIG. 8.

Figure 10A:
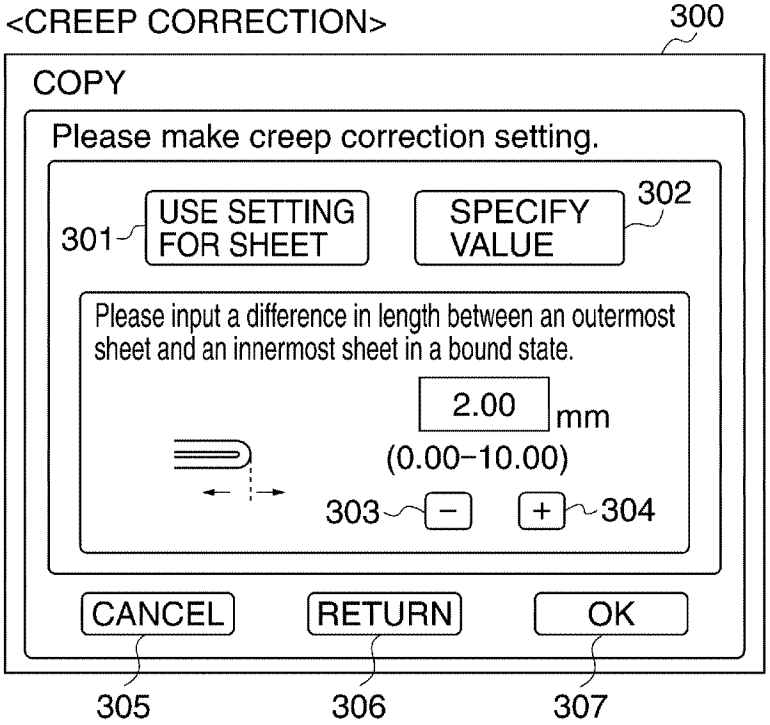
FIGS. 10A to 10F are schematic diagrams of screens which are displayed on a console section appearing in FIG. 8.
Figure 10B:
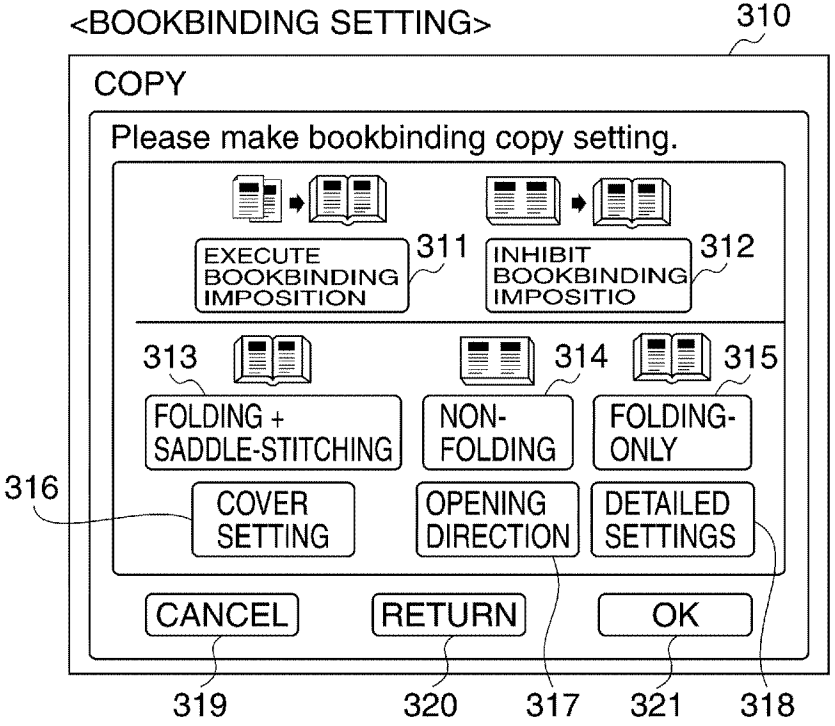
Figure 10D:
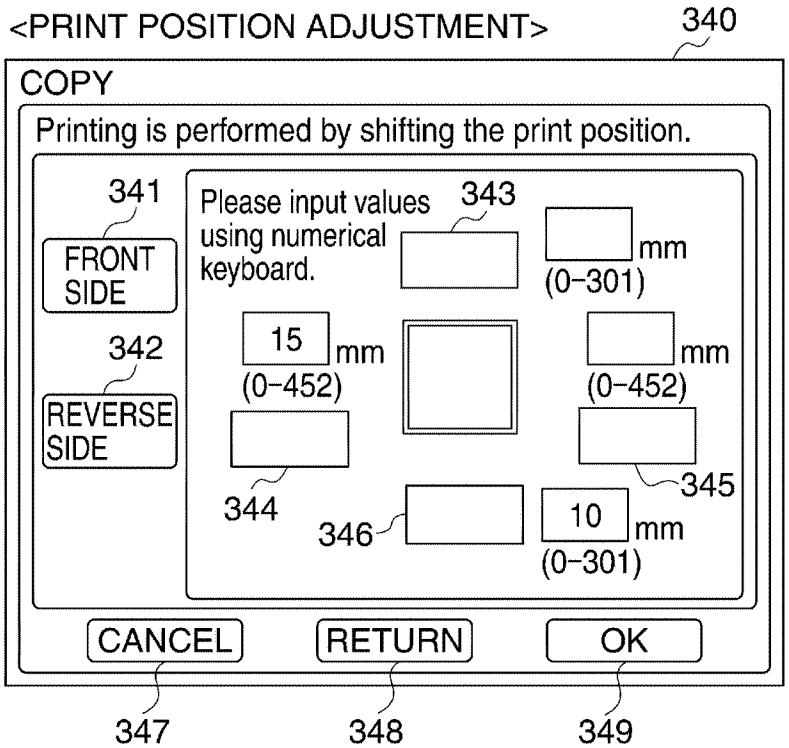
Figure 10C:
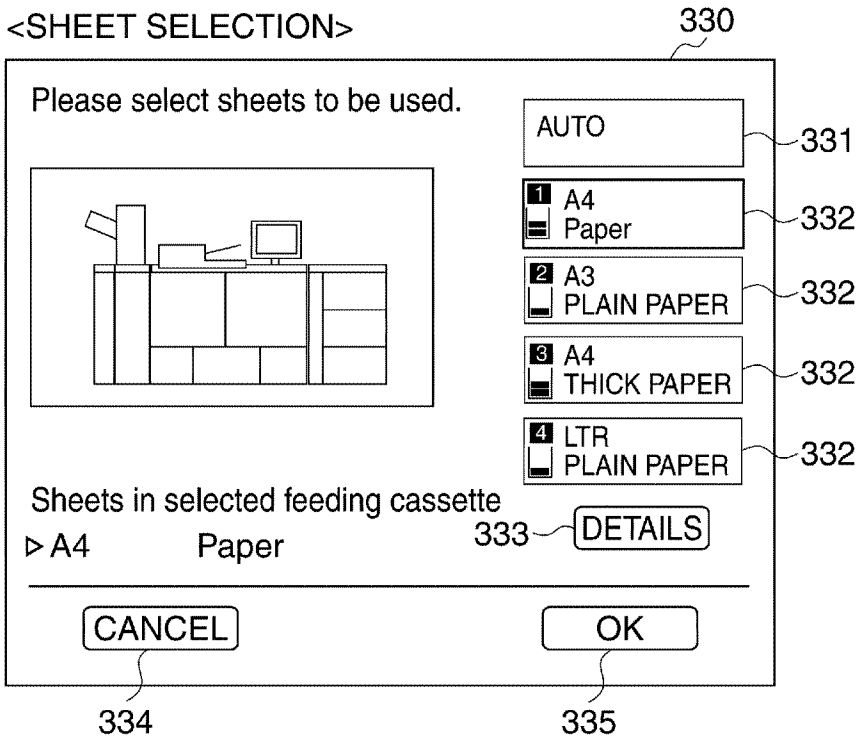
Figure 10E:
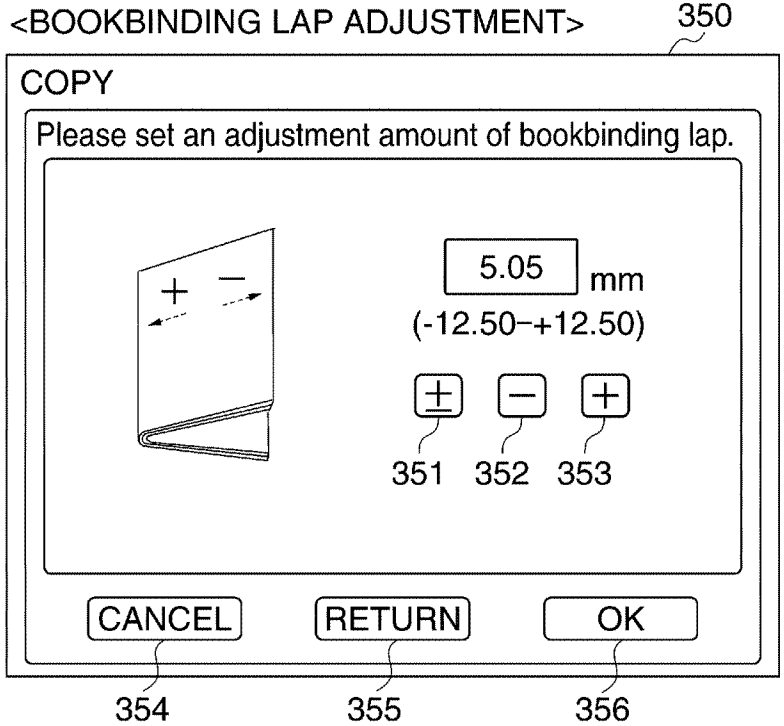
Figure 10F:
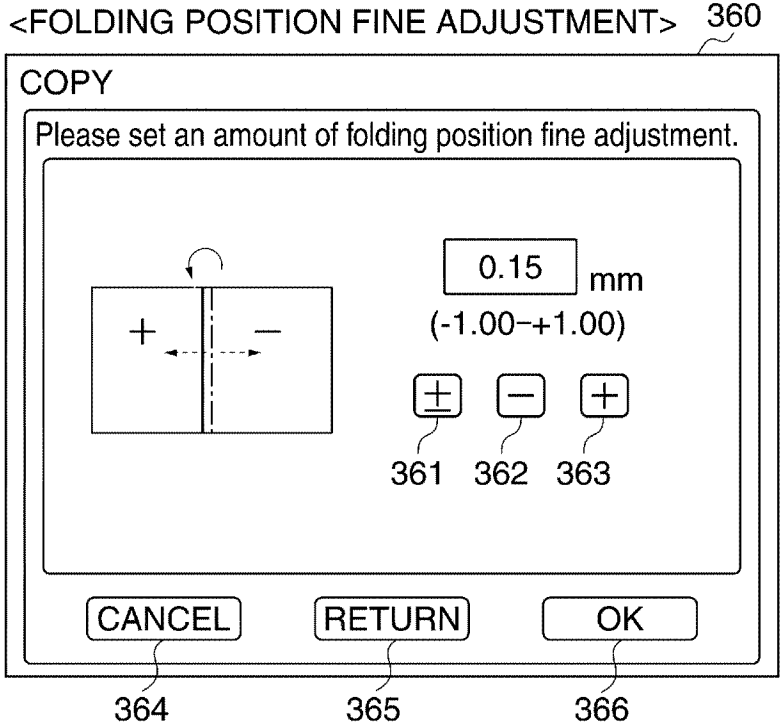

FIG. 10A shows a creep correction screen 300. FIG. 10B shows a bookbinding setting screen 310. FIG. 10C shows a sheet selection screen 330 used in the copy function. FIG. 10D shows a print position adjustment screen 340. FIG. 10E shows a bookbinding lap adjustment screen 350. FIG. 10F shows a folding position fine adjustment screen 360.

Note that although an example using the settings for the copy function will be described hereafter, it is assumed that there are screens for configuring settings for similar functions of a print job to the above. When a print job is input from an information processing apparatus, not shown, via the LAN 122, settings made on associated screens for setting the respective functions for the print job are made effective.

Upon receipt of a request for using a creep correction function from an operator via the console section 121, the creep correction screen 300 shown in FIG. 10A is displayed in a manner switched from a standby screen, not shown. The creep correction screen is a screen used for configuring how to perform creep correction and setting a correction amount.

The creep correction function is a function for automatically shifting a print position, by taking into consideration that when sheets for bookbinding printing are stacked and folded, an inner sheet protrudes more outward than an outer sheet, depending on the thickness of each sheet. By using the creep correction function, printing is performed in such a manner that spacing between pages to be printed on one side of a sheet is gradually reduced as the sheet is a more inner one.

Finally, the sheets are trimmed such that the protruding portions are cut off. The creep correction function is enabled only when a button 311 named as "execute bookbinding imposition" is selected in FIG. 10B, described hereinafter, and at the same time a sheet to be used enables bookbinding imposition.

Buttons 301 and 302 are used for selecting a method of determining a correction amount. The button 301 named as "use setting for sheet" is button for selecting application of a creep correction amount set for sheets from a detailed sheet settings screen, not shown.

In a state where the button 301 is selected, the operator cannot input an adjustment amount for creep correction from the creep correction screen 300 which is displayed. The user sets a creep correction amount for a sheet type from the detailed sheet settings screen, not shown, in a state where the "use setting for sheet" button 301 is selected and stored. Further, when the user selects the sheet type to which the creep correction amount is set as a type of sheets to be used, from the screen shown in FIG. 10C, referred to hereinafter, the creep correction is enabled.

The button 302 named as "specify value" is used to select specifying a creep correction amount, and when the user selects the button 302, a plus button 304 and a minus button 303 are made selectable.

Although the creep correction amount specified here is a length of shift between an outermost sheet and an innermost sheet of a finished book, a correction amount per one sheet may be set as the creep correction amount. The plus button 304 and the minus button 303, or a numerical keyboard, not shown, included in the console section 121 are/is used to specify the creep correction amount.

Only one of the "use setting for sheet" button 301 and the "specify value" button 302 can be set to the selected state. When the operator selects the "specify value" button 302 after selecting the "use setting for sheet" button 301, the "use setting for sheet" button 301 is released from the selected state, and the "specify value" button 302 is set to the selected state. This applies vice versa.

In a state where the "specify value" button 302 is selected, the minus button 303 and the plus button 304 are placed in an enabled state enabling the operator to operate them. When the minus button 303 or plus button 304 is operated on the creep correction screen 300, a value of the creep correction amount is entered.

When the minus button 303 is operated on the creep correction screen 300, the creep correction amount is temporarily decremented, and the displayed creep correction amount is updated.

When the plus button 304 is operated on the creep correction screen 300, the creep correction amount is temporarily incremented, and the displayed creep correction amount is updated.

Further, when the minus button 303 and the plus button 304 are in the enabled state, the operator may perform the creep correction by entering a value using the numerical keyboard, not shown, included in the console section 121.

A cancel button 305 aborts the creep correction setting. When the cancel button 305 is operated on the creep correction screen 300, the creep correction setting information which has been temporarily stored is abandoned, and the standby screen is displayed.

A return button 306 terminates the creep correction setting. When the return button 306 is operated on the creep correction screen 300, the standby screen is displayed without temporarily storing the creep correction setting information.

An OK button 307 completes the creep correction setting. In a state where one of the "use setting for sheet" button 301 and the "specify value" button 302 is selected, the operator can select the OK button 307.

When neither the "use setting for sheet" button 301 nor the "specify value" button 302 is set, the OK button 307 is not enabled.

Further, when the OK button 307 is operated on the creep correction screen 300, the method of setting a creep correction amount according to a selected one of the "use setting for sheet" button 301 and the "specify value" button 302 is temporarily stored, and the standby screen is displayed. Further, if the "specify value" button 302 has been selected, the set creep correction amount is temporarily stored, and the standby screen is displayed.

The bookbinding setting screen 310 shown in FIG. 10B is an example of a screen used for configuring settings for printing and settings for finishing, so as to perform bookbinding printing according to a copy job.

Setting items for bookbinding include three items for setting whether bookbinding imposition is to be executed, whether folding in the middle of a print product is to be executed after printing, and whether stitching in the middle of a print product is to be executed after printing, as well as items for setting a cover, setting a direction of opening a finished book, and so forth. These items can be set in combination.

Note that imposition refers to the laying out of pages for printing. If normally scanned images are printed in the scanned order, the printed pages are not in a proper order in a saddle-stitched book. A function for performing printing such that the saddle-stitched book has a correct page order is referred to as the bookbinding imposition function.

The "execute bookbinding imposition" button 311 and an "inhibit bookbinding imposition" button 312 are used to select whether or not to use the bookbinding imposition function.

The "execute bookbinding imposition" button 311 is set to a selected state when the operator operates the "execute bookbinding imposition" button 311. If the settings are stored when the "execute bookbinding imposition" button 311 is in the selected state, bookbinding imposition is performed for copy jobs to be executed thereafter. The operator has to select sheets having a size which enables bookbinding imposition in association with read original sheets, from the sheet selection screen shown in FIG. 10C, referred to hereinafter.

The "inhibit bookbinding imposition" button 312 is set to a selected state when the operator operates the "inhibit bookbinding imposition" button 312. If the settings are stored when the "inhibit bookbinding imposition" button 312 is in the selected state, copy jobs to be executed thereafter are executed without performing bookbinding imposition.

When the operator desires to perform bookbinding using a center-folding function, referred to hereinafter, without performing bookbinding imposition, originals read by the scan operation has to be originals on which bookbinding imposition has been performed.

Only one of the "execute bookbinding imposition" button 311 and the "inhibit bookbinding imposition" button 312 can be set to the selected state. If the operator selects the "inhibit bookbinding imposition" button 312 after selecting the "execute bookbinding imposition" button 311, the "execute bookbinding imposition" button 311 is released from the selected state, and the "inhibit bookbinding imposition" button 312 is set to the selected state. This applies vice versa.

Finishing processing to be performed on print products after printing is selected through operation of buttons 313 to 315 by the operator.

Of the button 313 named as "folding+saddle-stitching", the button 314 named as "non-folding", and the button 315 named as "folding only", buttons which the operator can operate are limited by the capabilities of the finisher 109 connected to the sheet processing apparatus 90 via the accessory interface 108.

The CPU 101 acquires capability information of the connected finisher 109 via the accessory interface 108. If the CPU 101 determines based on the acquired capability information that the finisher 109 is capable of performing center-fold processing, the CPU 101 makes the "folding only" button 315 selectable.

Further, if the CPU 101 determines that the finisher 109 is capable of performing saddle-stitch processing for stapling sheets in the middle, the CPU 101 makes the "folding+saddle-stitching" button 313 selectable. If the CPU 101 determines that the finisher 109 is not capable of performing center-fold processing, the CPU 101 makes only the "non-folding" button 314 selectable.

The "folding+saddle-stitching" button 313 is set to a selected state when the operator operates the "folding+saddle-stitching" button 313. If the settings are stored when the "folding+saddle-stitching" button 313 is in the selected state, center-fold processing and saddle-stitch processing are performed for copy jobs to be executed thereafter. The operator has to select sheets which enable center-fold processing and saddle-stitch processing, from the sheet selection screen shown in FIG. 10C, referred to hereinafter.

Depending on the number of sheets of a print product, there is a case where at least one of center-fold processing and saddle-stitch processing cannot be performed. This determination is performed by the CPU 101, and the copy job is cancelled or terminated without performing center-fold processing or saddle-stitch processing.

The "non-folding" button 314 is set to a selected state when the operator operates the "non-folding" button 314. If the settings are stored when the "non-folding" button 314 is in the selected state, neither center-fold processing nor saddle-stitch processing is performed for copy jobs to be executed thereafter.

The "folding only" button 315 is set to a selected state when the operator operates the "folding only" button 315. If the settings are stored when the "folding only" button 315 is in the selected state, center-fold processing is performed for copy jobs to be executed thereafter. The operator has to select sheets which enable center-fold processing, from the sheet selection screen shown in FIG. 10C, referred to hereinafter.

Depending on the number of sheets of a print product, there is a case where center-fold processing cannot be performed. This determination is performed by the CPU 101, and if it is determined that center-fold processing cannot be performed, the copy job is cancelled or terminated without performing center-fold processing.

As described hereinbefore, center-fold processing is a function used also in a case where binding processing is performed using another system (off-line apparatus) which is different from the sheet processing apparatus 90, from the viewpoints of productivity, quality, and binding performance. In a case where binding processing is executed for bookbinding, opposite ends of sheets, which are to form a fore edge of a book, referred to hereinafter, are required to be made different in position when the sheets are folded. The difference in position of the opposite ends, i.e. opposite fore edge portions, of each folded sheet (a distance between a first sheet end and a second sheet end of each sheet assumed to have been folded in two) is generally referred to as the lap. The lap can be set using the screen shown in FIG. 10E, referred to hereinafter.

Only one of the "folding+saddle-stitching" button 313, the "non-folding" button 314, and the "folding only" button 315 can be set to the selected state. When the operator operates another button when one of the above-mentioned buttons is in the selected state, the button which has been selected is released from the selected state, and then the button which the operator has newly operated is set to the selected state.

When the operator operates a cover setting button 316, the screen is shifted to a cover setting screen, not shown, for configuring the settings of a cover. On the cover setting screen, it is possible to set a printing side of a sheet for a page corresponding to a cover of a finished book, and a printing sheet separately from the settings of text of the book.

When the operator operates an opening direction button 317, the screen is shifted to an opening direction-setting screen, not shown, for setting a direction of opening a finished book (binding direction). On the opening direction-setting screen, the operator can operate the cover setting button 316 only when the "execute bookbinding imposition" button 311 has been selected. When the "execute bookbinding imposition" button 311 has not been selected, even if the operator has set the opening direction on the cover setting screen in advance, the CPU 101 disables the setting of the opening direction.

When the operator operates a detailed settings button 318, the screen is shifted to a detailed settings screen, not shown, for configuring other detailed bookbinding settings.

A cancel button 319 is used for aborting the bookbinding setting. When the operator operates the cancel button 319, the bookbinding setting information which has been temporarily stored is abandoned, and the standby screen is displayed.

A return button 320 is used for terminating the bookbinding setting. When the operator operates the return button 320, the standby screen is displayed without temporarily storing the bookbinding setting information.

An OK button 321 is used for completing the bookbinding setting. The operator can operate the OK button 321 in a state where one of the "execute bookbinding imposition" button 311 and the "inhibit bookbinding imposition" button 312, and one of the "folding+saddle-stitching" button 313, the "non-folding" button 314, and the "folding only" button 315 are selected.

When neither the "execute bookbinding imposition" button 311 nor the "inhibit bookbinding imposition" button 312 is selected, or neither the "folding+saddle-stitching" button 313 nor "non-folding" button 314 nor the "folding only" button 315 is selected, the OK button 321 cannot be operated.

When the operator operates the OK button 321, information on the selected ones of the buttons 311 to 315, indicating that those buttons have been selected, is temporarily stored.

Further, the settings configured on the cover setting screen, the opening direction-setting screen, and the detailed settings screen, none of which are shown, are similarly stored, and the standby screen is displayed.

The sheet selection screen 330 shown in FIG. 10C is displayed for indicating sheet sizes and sheet types currently set to the respective sheet feed cassettes 18 provided in the printer engine 120, and enabling the operator to set output sheet size and type information for printing.

The output sheet size information indicates regular sheet sizes, such as A4, A3, B4, B5, and Letter, and an irregular sheet size which is input by the operator on an irregular size input screen, not shown, via the console section 121, and each sheet size is associated with a longitudinal length and a lateral length.

Further, the sheet type information indicates two kinds of sheet types: a sheet type stored in an area of the HDD 104 of the sheet processing apparatus in advance, and a sheet type input by the operator on a sheet type registration screen via the console section 121 and stored in an area of the HDD 104.

The sheet type information includes information on a weight per unit area of a sheet, surface properties, such as matte paper, glossy paper, and plain paper, and a shape, such as an index sheet and an envelope. The above-mentioned information is used to perform printing by the printer engine 120 according to the optimum settings for a sheet.

An automatic setting button 331 is used for specifying that output sheet setting is to be automatically performed according to the size of an original image for printing and the print settings. When the operator operates the automatic setting button 331, the output sheet setting is performed by an output sheet-setting process, described hereinafter. The automatic setting button 331 is set to a selected state when the operator operates the automatic setting button 331.

Sheet setting buttons 332 are associated with the sheet feed cassettes 18, respectively, which are held in the printer engine 120. The sheet setting buttons 332 are displayed in number corresponding to the number of sheet feed cassettes which varies with the configuration of the sheet processing apparatus 90.

In this example, the printer engine 120 includes four sheet feed cassettes 18, and hence the four sheet setting buttons 332 are displayed.

The settings information stored in the RAM 102 includes sheet size information and sheet type information set as the sheet size and sheet type of sheets contained in each sheet feed cassette 18. The sheet size information and the sheet type information set as the sheet size and the sheet type, respectively, are set by the operator via the console section 121. Alternatively, in a case where each sheet feed cassette 18 has a function for automatically detecting a sheet size, the detected size is notified to the CPU 101 via the printer engine 120, the printer image processing section 118, and the device interface 113, as the sheet size information, and then set as the sheet size.

Further, when it is detected that any of the sheet feed cassettes 18 contains no sheets, the CPU 101 receives no-sheet information, and sets one of the sheet setting buttons 332 associated with the corresponding sheet feed cassette to a non-selectable state.

On each sheet setting button 332, the output sheet size information and output sheet type information set to an associated one of the sheet feed cassettes 18, and a rough indication of a remaining amount of sheets in the associated one of the sheet feed cassettes 18, which is detected by the sheet feed cassette, are displayed.

The rough indication of the remaining amount of sheets is set by notifying the CPU 101 of the remaining amount via the printer engine 120, the printer image processing section 118, and the device interface 113.

Each sheet setting button 332 is set to the selected state when the operator operates the sheet setting button 332 in a state where the sheet setting button 332 is in the selectable state.

Only one of the automatic setting button 331 and the sheet setting buttons 332 is set to the selected state. As far as the selected state is concerned, the automatic setting button 331 is regarded as one of the sheet setting buttons 332, and operates similarly to the sheet setting buttons 332.

After one of the sheet setting buttons 332 has been selected, if another sheet setting button 332 is selected, the one sheet setting button 332 which has been selected is released from the selected state, and the another sheet setting button 332 which is newly selected is set to the selectable state.

A details button 333 can be selected only in a state where one of the sheet setting buttons 332 is selected, and cannot be selected when the automatic setting button 331 is selected.

When the operator operates the details button 333 in the selectable state, a sheet type details screen, not shown, for displaying sheet type information set to one of the sheet feed cassettes 18 associated with the sheet setting button 332 selected at that time is displayed.

This screen displays associated sheet type information stored in the HDD 104 as the sheet type information, and the operator can change the registered sheet type information, as required, by operating the console section 121.

A cancel button 334 is used for aborting the output sheet selection. When the operator operates the cancel button 334, the standby screen is displayed without temporarily storing the output sheet information.

An OK button 335 is used for completing the output sheet selection. The operator can operate the OK button 335 when the automatic setting button 331 or one of the sheet setting buttons 332 is in the selected state.

The OK button 335 cannot be operated when neither the automatic setting button 331 nor one of the sheet setting buttons 332 is in the selected state. When the operator operates the OK button 335, information indicative of the output sheet size and type, associated with the selected button, is temporarily stored in the setting information in the RAM 102 as the output sheet information in the copy settings, and the standby screen is displayed.

The print position adjustment screen 340 shown in FIG. 10D is displayed for enabling the operator to perform adjustment of a print position for a copy job.

The print position adjustment is a function for setting layout by shifting the position of an original image with respect to an output sheet. A front side button 341 and a reverse side button 342 are used to select whether or not to set a set value used in printing of a front side of a sheet, and whether or not to set a set value used in printing of a reverse side of the sheet, respectively.

Shift direction designation buttons 343, 344, 345, and 346 are associated with upward, leftward, rightward, and downward directions respectively.

When the front side button 341 or the reverse side button 342 is operated for selection, the button operated by the operator is set to a selected state. Only one of the front side button 341 and the reverse side button 342 is set to the selected state. After one of the front side button 341 and the reverse side button 342 has been selected, if the other is selected, the precedingly selected button is released from the selected state, and the newly selected button is set to the selected state.

The operator can operate the shift direction designation buttons 343, 344, 345, and 346 when the front side button 341 or the reverse side button 342 is in a selected state. If the operator operates any of the shift direction designation buttons 343, 344, 345, and 346 in this state, the operated shift direction designation buttons 343, 344, 345, and 346 is set to the selected state. In a state where neither the front side button 341 nor the reverse side button 342 is selected, none of the shift direction designation buttons 343, 344, 345, and 346 can be operated.

Only one of the shift direction designation buttons 343, 344, 345, and 346 is set to the selected state. After one of the shift direction designation buttons 343, 344, 345, and 346 has been selected, if another one is selected, the precedingly selected shift direction designation button is released from the selected state, and the newly selected shift direction designation button is set to the selected state.

The operator can input a shift amount by operating the numerical keyboard, not shown, included in the console section 121, when one of the shift direction designation buttons 343, 344, 345, and 346 is in the selected state.

When the numerical keyboard is operated, the shift amount in a direction corresponding to the selected printing side and shift direction designation button is temporarily changed, and the displayed shift amount is updated.

A cancel button 347 is used for aborting the print position adjustment. When the operator operates the cancel button 347, the temporarily stored print position adjustment is abandoned, and the standby screen is displayed.

A return button 348 is used for terminating the print position adjustment. When the operator operates the return button 348, the standby screen is displayed without temporarily storing the print position adjustment.

An OK button 349 is used for completing the print position adjustment. The operator can operate the OK button 349 when one of the front side button 341 and the reverse side button 342 and one of the shift direction designation buttons 343, 344, 345, and 346 are in the selected state.

When neither the front side button 341 nor the reverse side button 342 is in the selected state, or none of the shift direction designation buttons 343, 344, 345, and 346 is in the selected state, the OK button 349 cannot be operated. When the operator operates the OK button 349, the side of a sheet to be subjected to the print position adjustment, the shift direction, and the shift amount are temporarily stored, and the standby screen is displayed.

The bookbinding lap adjustment screen 350 shown in FIG. 10E is displayed for enabling the operator to perform bookbinding lap adjustment for a copy job.

The bookbinding lap adjustment is, as mentioned above, a function for adjusting a lap which is a difference in position of opposite ends, i.e. opposite fore edge portions, of sheets, which are to form the fore edge of a book, provided when the sheets are folded. The lap is necessary when binding processing is executed for bookbinding printing processing.

A minimum necessary lap is approximately 5.0 mm, and a lap of approximately 10 mm is considered as a most preferable lap. The bookbinding lap adjustment set on the screen shown in FIG. 10E is enabled only when a copy job is executed in a state where the "folding only" button 315 has been selected and stored for the finishing processing function shown in FIG. 10B.

When the operator operates a minus button 352 and a plus button 353, a bookbinding lap adjustment value is set.

When the operator operates the minus button 352, the bookbinding lap adjustment value is temporarily incremented, and the displayed bookbinding lap adjustment value is updated.

When the operator operates the plus button 353, the bookbinding lap adjustment value is temporarily decremented, and the displayed bookbinding lap adjustment value is updated.

When the operator operates a plus-minus button 351, the sign of the bookbinding lap adjustment value is reversed, and the displayed bookbinding lap adjustment value is updated.

Further, in a state where the screen shown in FIG. 10E is displayed, the operator may set a bookbinding lap adjustment value using the numerical keyboard, not shown, included in the console section 121.

Note that when the value of the bookbinding lap adjustment value is positive, it indicates a set value for advancing a fore edge portion of each sheet, which is associated with a larger page number of a finished book set to a left-to-right page layout, i.e. increasing the distance of the fore edge portion from the fold line of the sheet. The value thus set is generally referred to as a value of high lap.

On the other hand, when the value of the bookbinding lap adjustment value is negative, it indicates a set value for advancing a fore edge portion of the sheet, which is associated with a smaller page number of the finished book set to the left-to-right page layout, i.e. increasing the distance of the fore edge portion from the fold line of the sheet. The value thus set is generally referred to as a value of low lap. Note that when the finished book is set to a right-to-left page layout, the fore edge portions which are advanced according to the high lap and low lap, respectively, are opposite to the above.

A cancel button 354 is used for aborting the bookbinding lap adjustment. When the operator operates the cancel button 354, the temporarily stored bookbinding lap adjustment is abandoned, and the standby screen is displayed.

A return button 355 is used for terminating the bookbinding lap adjustment. When the operator operates the return button 355, the standby screen is displayed without temporarily storing the bookbinding lap adjustment.

An OK button 356 is used for completing the bookbinding lap adjustment. When the operator operates the OK button 356, the bookbinding lap adjustment is temporarily stored, and the standby screen is displayed.

The folding position fine adjustment screen 360 shown in FIG. 10F is displayed for enabling the operator to performing folding position fine adjustment.

The folding position fine adjustment is a function for correcting a slight amount of erroneous shift of a folding position from the center of a sheet, caused by an error inherent to the sheet processing apparatus or variation between production lots of sheets.

When the operator operates a minus button 362 or a plus button 363, a folding position fine adjustment value is set.

When the operator operates the minus button 362, the folding position fine adjustment value is temporarily incremented, and the displayed folding position fine adjustment value is updated.

When the operator operates the plus button 363, the folding position fine adjustment value is temporarily decremented, and the displayed folding position fine adjustment value is updated.

When the operator operates a plus-minus button 361, the sign of the folding position fine adjustment value is reversed, and the displayed folding position fine adjustment value is updated.

Further, in a state where the screen shown in FIG. 10F is displayed, the operator may set a folding position fine adjustment value using the numerical keyboard, not shown, included in the console section 121.

Note that a positive direction in the folding position adjustment is a direction of adjusting the folding position leftward and a negative direction is a direction of adjusting the folding position rightward, for bookbinding of a book set to a left-to-right page layout.

A cancel button 364 is used for aborting the folding position fine adjustment. When the operator operates the cancel button 364, the temporarily stored folding position fine adjustment is abandoned, and the standby screen is displayed.

A return button 365 is used for terminating the folding position fine adjustment. When the operator operates the return button 365, the standby screen is displayed without temporarily storing the folding position fine adjustment.

An OK button 366 is used for completing the folding position fine adjustment. When the operator operates the OK button 366, the folding position fine adjustment is temporarily stored, and the standby screen is displayed.

Figure 11:
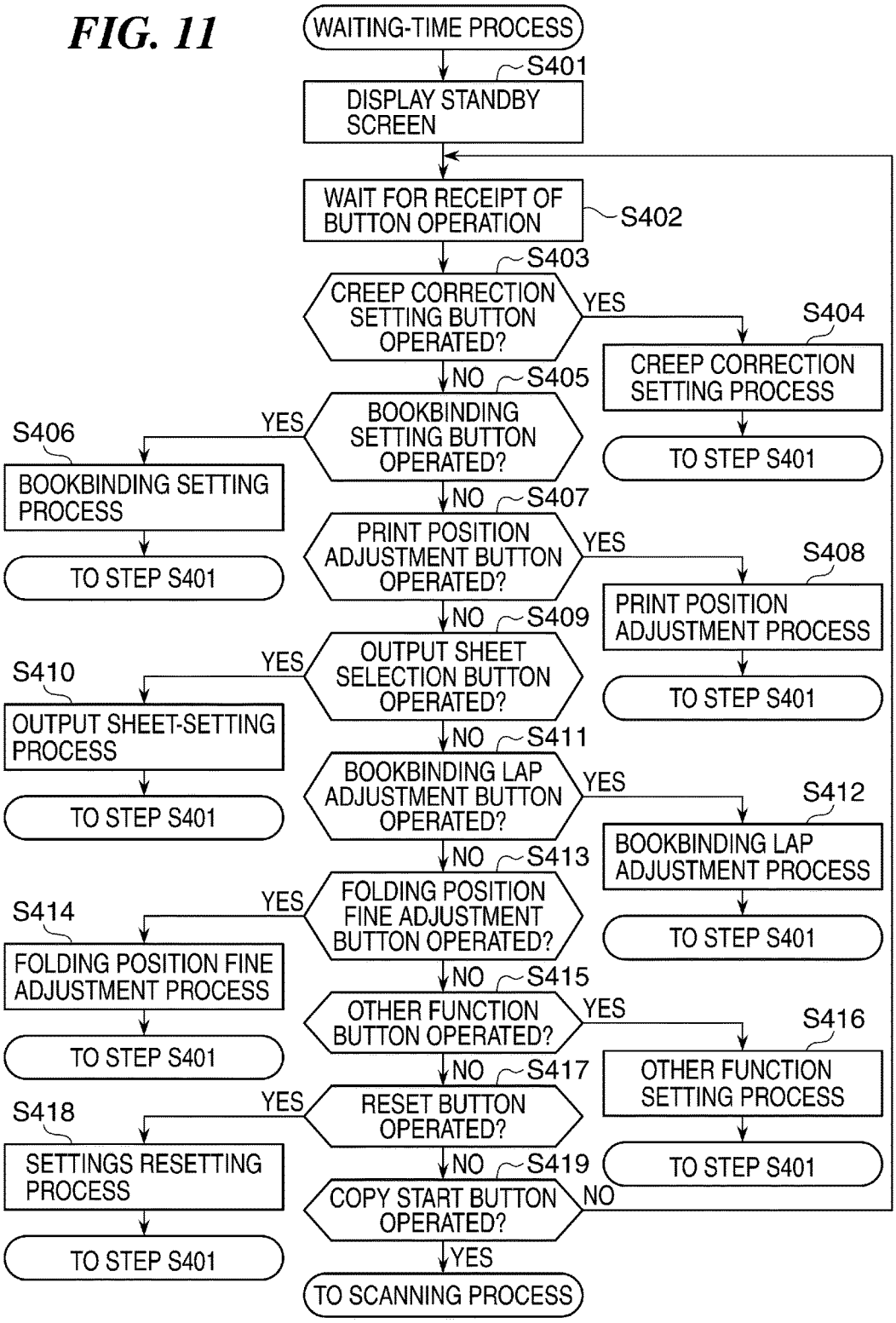
FIG. 11 is a flowchart of a waiting-time process executed by a CPU appearing in FIG. 8.

FIG. 11 is a flowchart of a waiting-time process executed by the CPU 101 appearing in FIG. 8.

FIG. 11 shows the waiting-time process which is started upon receipt of a request for using a copy function from an operator. Although the description is given of a case of the copy function by way of example, a similar process is executed for a print job.

The CPU 101 displays the standby screen, not shown, on the console section 121 (step S401), and waits until a button operation by the operator is received (step S402).

Upon receipt of an operation from the operator in this state, the CPU 101 determines whether or not a creep correction setting button, not shown, has been operated (step S403).

If it is determined in the step S403 that the creep correction setting button has been operated (YES to the step S403), the CPU 101 displays the creep correction screen 300 on the console section 121. Then, the CPU 101 executes the creep correction setting process for accepting the creep correction operation performed by the operator (step S404).

The creep correction process executed at this time has been described with reference to FIG. 10A. When the creep correction setting is accepted or canceled, the CPU 101 proceeds to the step S401.

On the other hand, if it is determined in the step S403 that the creep correction setting button has not been operated (NO to the step S403), the CPU 101 determines whether or not a bookbinding setting button, not shown, has been operated (step S405).

If it is determined in the step S405 that the bookbinding setting button has been operated (YES to the step S405), the CPU 101 displays the bookbinding setting screen 310 on the console section 121, and executes the bookbinding setting process for accepting the bookbinding setting operation performed by the operator (step S406).

The process executed at this time has been described with reference to FIG. 10B. When the bookbinding setting is accepted or canceled, the CPU 101 proceeds to the step S401.

On the other hand, if it is determined in the step S405 that the bookbinding setting button has not been operated (NO to the step S405), the CPU 101 determines whether or not a print position adjustment button, not shown, has been operated (step S407).

If it is determined in the step S407 that the print position adjustment button has been operated (YES to the step S407), the CPU 101 displays the print position adjustment screen 340 on the console section 121. Then, the CPU 101 executes the print position adjustment setting process for accepting the print position adjustment setting operation performed by the operator (step S408).

The process executed at this time has been described with reference to FIG. 10C. When the print position adjustment setting is accepted or canceled, the CPU 101 proceeds to the step S401.

On the other hand, if it is determined in the step S407 that the print position adjustment button has not been operated (NO to the step S407), the CPU 101 determines whether or not an output sheet selection button has been operated (step S409).

If it is determined in the step S409 that the output sheet selection button has been operated (YES to the step S409), the CPU 101 proceeds to a step S410. Then, the CPU 101 displays the sheet selection screen 330 on the console section 121, and executes the output sheet-setting process for accepting the output sheet selection operation performed by the operator (step S410).

The process executed at this time has been described with reference to FIG. 10D. When the output sheet setting is accepted or canceled, the CPU 101 proceeds to the step S401.

On the other hand, if it is determined in the step S409 that the output sheet selection button has not been operated (NO to the step S409), the CPU 101 determines whether or not a bookbinding lap adjustment button, not shown, has been operated (step S411).

If it is determined in the step S411 that the bookbinding lap adjustment button has been operated (YES to the step S411), the CPU 101 displays the bookbinding lap adjustment screen 350 on the console section 121. Then, the CPU 101 executes the bookbinding lap adjustment process for accepting a bookbinding lap adjustment operation performed by the operator (step S412). The step S412 corresponds to the operation of a setting unit configured to set a bookbinding lap which is defined as a difference in distance from a fold line to opposite fore edge portions of each recording sheet of a fold section to be formed by forming the fold line on recording sheets having images formed thereon by the printer engine 120, or a distance between opposite ends of each sheet assumed to have been folded in two. The finisher 109 forms a fold line on each recording sheet along a reference line shifted from the centerline indicative of a fold position in a case where no bookbinding lap is provided, by the bookbinding lap set in the step S412.

The process executed at this time has been described with reference to FIG. 10E. When the bookbinding lap adjustment is accepted or canceled, the CPU 101 proceeds to the step S401.

On the other hand, if it is determined in the step S411 that the bookbinding lap adjustment button has not been operated (NO to the step S411), the CPU 101 determines whether or not a folding position fine adjustment button has been operated (step S413).

If it is determined in the step S413 that the folding position fine adjustment button has been operated (YES to the step S413), the CPU 101 displays the folding position fine adjustment screen 360 on the console section 121. Then, the CPU 101 executes the folding position fine adjustment process for accepting a folding position fine adjustment operation performed by the operator (step S414). The step S414 corresponds to the operation of a fine adjustment unit configured to finely adjust a position of a fold line formed by the finisher 109.

The process executed at this time has been described using the folding position fine adjustment screen 360 with reference to FIG. 10F. When the folding position fine adjustment is accepted or canceled, the CPU 101 proceeds to the step S401.

On the other hand, if it is determined in the step S413 that the folding position fine adjustment button has not been operated (NO to the step S413), the CPU 101 determines whether or not an other-function button has been operated (step S415). Note that the other function refers to any print setting function other than the functions of creep correction, bookbinding setting, print position adjustment, output sheet setting, bookbinding lap adjustment, and folding position fine adjustment.

If it is determined in the step S415 that the other-function button has been operated (YES to the step S415), the CPU 101 displays a setting screen associated with the other function on the console section 121. Then, the CPU 101 executes the other setting process for accepting an operation performed by the operator, for setting the other function (step S416). A detailed description of the other setting process is omitted. When the other setting is accepted or canceled, the CPU 101 proceeds to the step S401.

On the other hand, if it is determined in the step S415 that the other-function button has not been operated (NO to the step S415), the CPU 101 determines whether or not a reset button, not shown, has been operated (step S417).

If it is determined in the step S417 that the reset button has been operated (YES to the step S417), the CPU 101 executes a reset process for resetting all copy settings stored in the RAM 102 to initial values (step S418), and proceeds to the step S401.

On the other hand, if it is determined in the step S417 that the reset button has not been operated (NO to the step S417), the CPU 101 determines whether or not a copy start button, not shown, has been operated (step S419).

Figure 12:
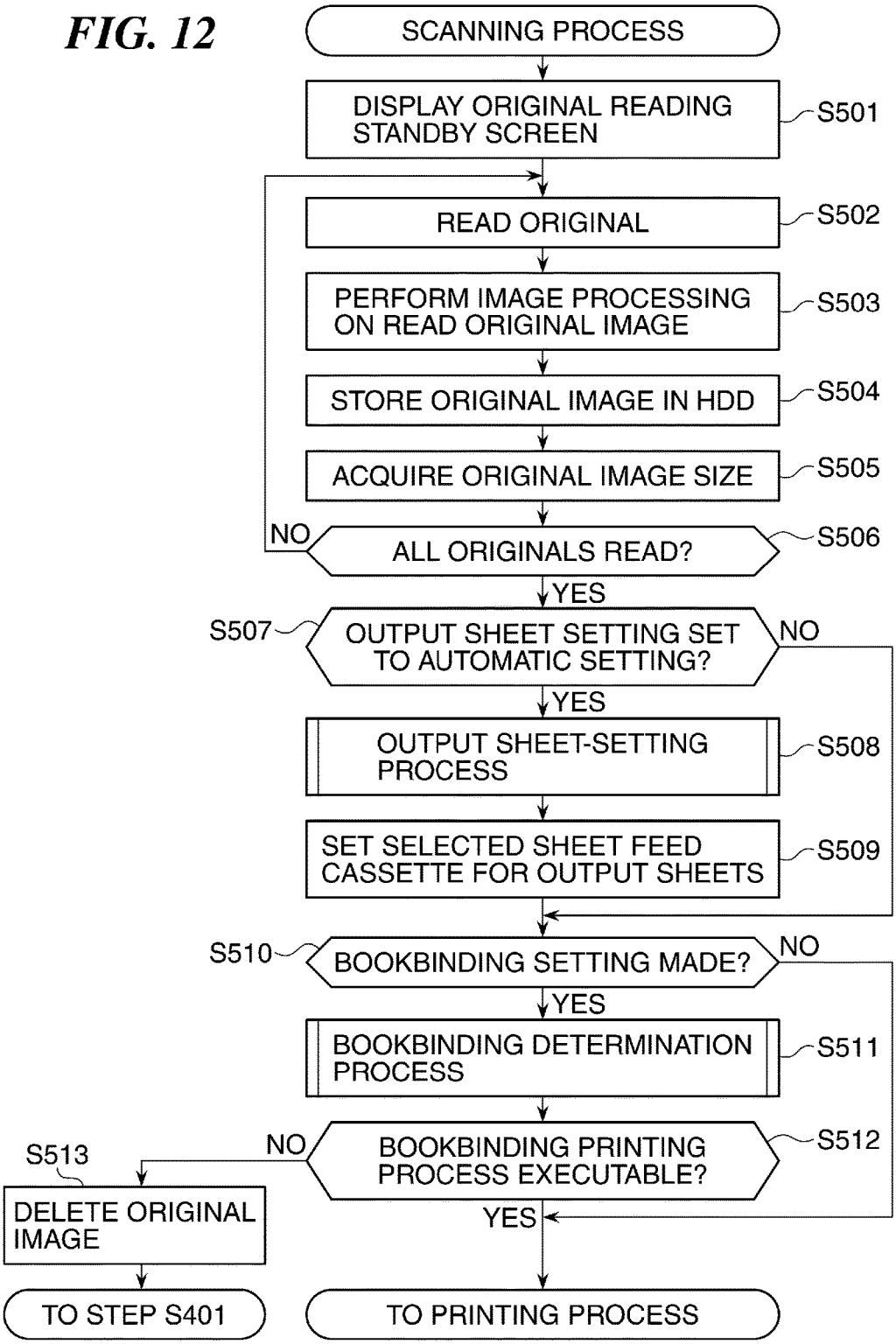
FIG. 12 is a flowchart of a scanning process executed by the CPU appearing in FIG. 8.

If it is determined in the step S419 that the copy start button has been operated (YES to the step S419), the CPU 101 proceeds to a scanning process shown in FIG. 12, followed by terminating the present process. On the other hand, if it is determined in the step S419 that the copy start button has not been operated (NO to the step S419), the CPU 101 proceeds to the step S402.

FIG. 12 is a flowchart of the scanning process executed by the CPU 101 appearing in FIG. 8.

In FIG. 12, the CPU 101 displays an original reading standby screen on the console section 121 (step S501).

Next, the CPU 101 instructs the scanner 119 to start reading of an original to thereby read the original (step S502).

Then, the CPU 101 performs image processing on the original image read by the scanner 119 (step S503). Details of the image processing are determined based on the copy settings which have been set and temporarily stored according to the waiting-time process in FIG. 11.

The CPU 101 determines whether image processing on the read original image is to be performed by the scanner image processing section 117 or by the image-editing image processing section 114, and instructs one of the scanner image processing section 117 and the image-editing image processing section 114, which is determined by the CPU 101, to perform image processing.

The CPU 101 checks whether or not an image processing completion notification has been received from the scanner image processing section 117 or the image-editing image processing section 114, and until it is confirmed that the image processing completion notification has been received, the CPU 101 remains at the step S503. If it is confirmed that the image processing completion notification has been received, the CPU 101 proceeds to a step S504.

In the step S04, the CPU 101 instructs the image compression section 116 to compress the original image subjected to image processing in the step S503, and when image compression processing is completed, the CPU 101 stores the compressed original image in the HDD 104.

When the original image has been stored, the CPU 101 acquires the size of the original image, i.e. the longitudinal and lateral sizes of the original image which has been subjected to image processing in the step S503 (step S505), and temporarily stores the acquired original image size.

When the original image size has been stored, the CPU 101 determines whether or not the scanner 119 has read all of the originals (step S506). This is determined according to whether or not a notification indicative of completion of reading of the originals has been received from the scanner 119.

If it is determined in the step S506 that the scanner 119 has not read all of the originals (NO to the step S506), the process returns to the step S502.

On the other hand, if it is determined in the step S506 that the scanner 119 has read all of the originals (YES to the step S506), the CPU 101 determines whether or not the output sheet setting is set to the automatic setting (step S507).

If it is determined in the step S507 that the output sheet setting is not set to the automatic setting (NO to the step S507), the CPU 101 proceeds to a step S510.

On the other hand, if it is determined in the step S507 that the output sheet setting is set to the automatic setting (YES to the step S507), the CPU 101 executes an output sheet-setting process (step S508). The output sheet-setting process will be described hereinafter with reference to the FIG. 13.

When the output sheet-setting process is terminated, the CPU 101 sets sheet settings associated with the sheet setting button in the selected state as the output sheet setting to thereby sets one of the sheet feed cassettes 18 selected by the operator for the output sheet (step S509).

Next, the CPU 101 determines whether or not bookbinding setting has been made (step S510). If it is determined in the step S510 that the bookbinding setting has not been made (NO to the step S510), the CPU 101 proceeds to a printing process, described hereinafter, with reference to FIG. 15.

On the other hand, if it is determined in the step S510 that the bookbinding setting has been made (YES to the step S510), the CPU 101 executes a bookbinding determination process based on the original image and the output sheet setting, and a capability value of the finisher 109 (step S511). The bookbinding determination process will be described hereinafter with reference to FIG. 14.

When the bookbinding determination process is terminated, the CPU 101 determines whether or not bookbinding printing processing is determined to be executable by the bookbinding determination process in the step S511 (step S512). If it is determined in the step S512 that bookbinding printing processing is determined to be executable (YES to the step S512), the CPU 101 proceeds to the above-mentioned printing process.

On the other hand, if it is determined in the step S512 that bookbinding printing processing is determined to be inexecutable (NO to the step S512), the CPU 101 cancels the copy operation. Then, the CPU 101 instructs deletion of the original image stored in the HDD 104 in the step S504 (step S513), and deletes the setting information which has been temporarily internally stored.

Further, the CPU 101 notifies the scanner 119, the printer engine 120, and the console section 121 of cancellation of the copy operation, and proceeds to the step S401 in FIG. 11, followed by terminating the present process.

Figure 13:
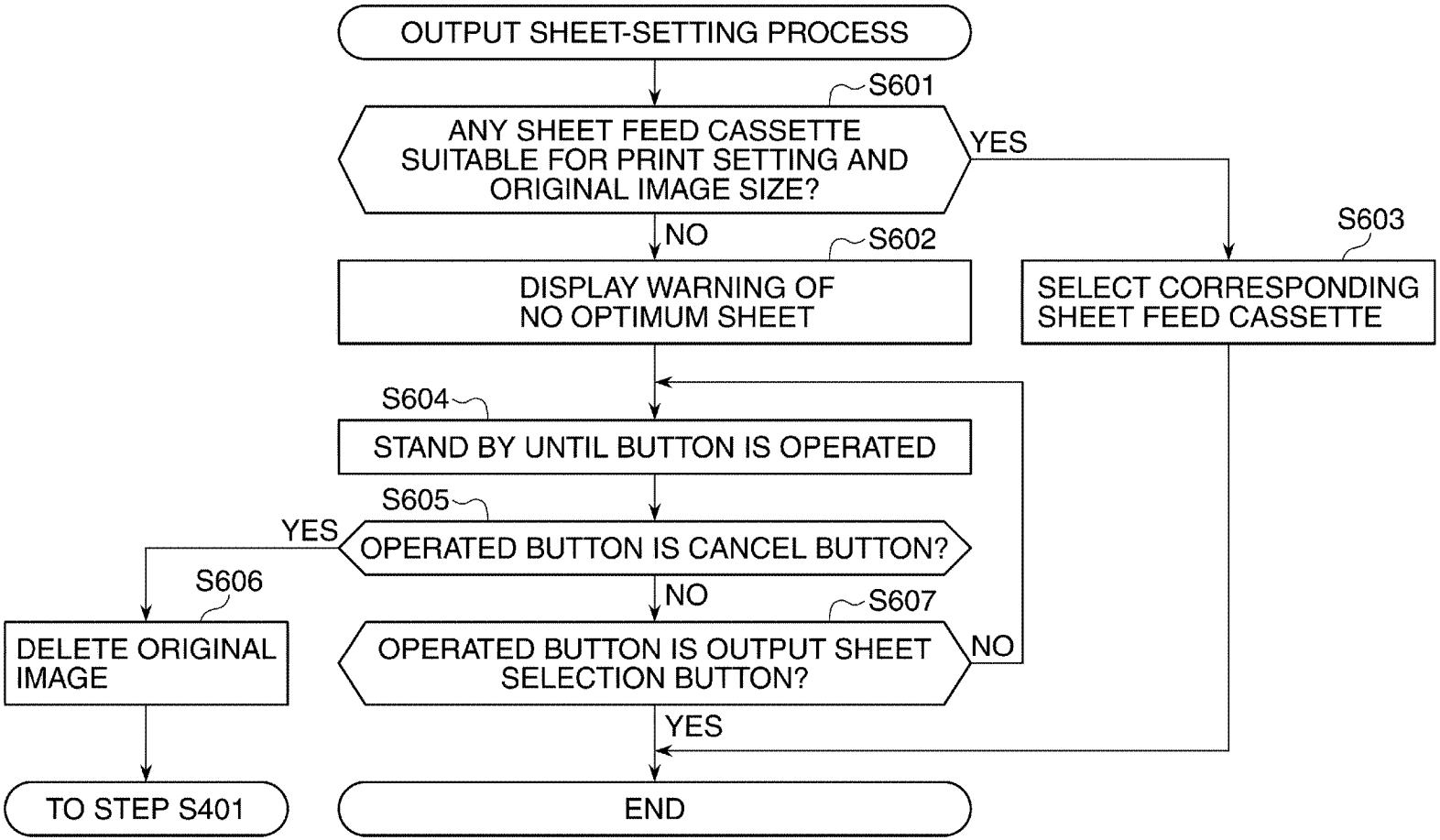
FIG. 13 is a flowchart of an output sheet-setting process executed by the CPU appearing in FIG. 8.

FIG. 13 is a flowchart of the output sheet-setting process executed by the CPU 101 appearing in FIG. 8.

In the output sheet-setting process shown in FIG. 13, first, the CPU 101 calculates the size (resolution) of an original image to be printed based on the longitudinal and lateral sizes of the original image, which have been stored in the step S505, the print settings stored in the RAM 102, and the print resolution of the printer engine 120.

Then, the CPU 101 determines whether or not there is a sheet feed cassette set to a sheet size that enables printing of the original image of the calculated size. In addition, the CPU 101 determines whether or not the sheet type of the sheet feed cassette enables printing according to the print settings stored on the RAM 102.

That is, the CPU 101 determines whether or not there is a sheet feed cassette 18 suitable for the print settings and the original image size (step S601).

If it is determined in the step S601 that there is a sheet feed cassette 18 suitable for the print settings and the original image size (YES to the step S601), the CPU 101 proceeds to a step S603, wherein the CPU 101 selects the sheet feed cassette 18 set to the printable sheet size, which has been determined in the step S601, for the output sheet setting, followed by terminating the present process (step S603).

On the other hand, if it is determined in the step S601 that there is no sheet feed cassette 18 suitable for the print settings and the original image size (NO to the step S601), the CPU 101 displays a warning on the console section 121, indicating that there is no optimum sheet (step S602).

Then, the CPU 101 waits until a button operation is performed by the operator (step S604). More specifically, the CPU 101 checks whether or not the operator has operated the console section 121, and if the operator has operated the console section 121, the CPU 101 proceeds to a step S605, whereas if not, the CPU 101 remains at the step S604.

Then, the CPU 101 determines whether or not what the button operated in the step S604 is a cancel button, not shown (step S605).

If it is determined in the step S605 that the button operated in the step S604 is the cancel button (YES to the step S605), the CPU 101 cancels the copy operation. Then, the CPU 101 instructs deletion of the original image stored in the HDD 104 in the step S504 (step S606), and deletes the setting information which has been temporarily stored therein.

Further, the CPU 101 notifies the scanner 119, the printer engine 120, and the console section 121 of cancellation of the copy operation, and proceeds to the step S401 in FIG. 11, followed by terminating the present process.

On the other hand, if it is determined in the step S605 that the operated button is not the cancel button (NO to the step S605), the CPU 101 determines whether or not the button operated in the step S604 is the output sheet selection button (step S607).

If it is determined in the step S607 that the operated button is the output sheet selection button (YES to the step S607), the present process is terminated. On the other hand, if it is determined that the operated button is not the output sheet selection button (NO to the step S607), the process returns to the step S604.

Figure 14:
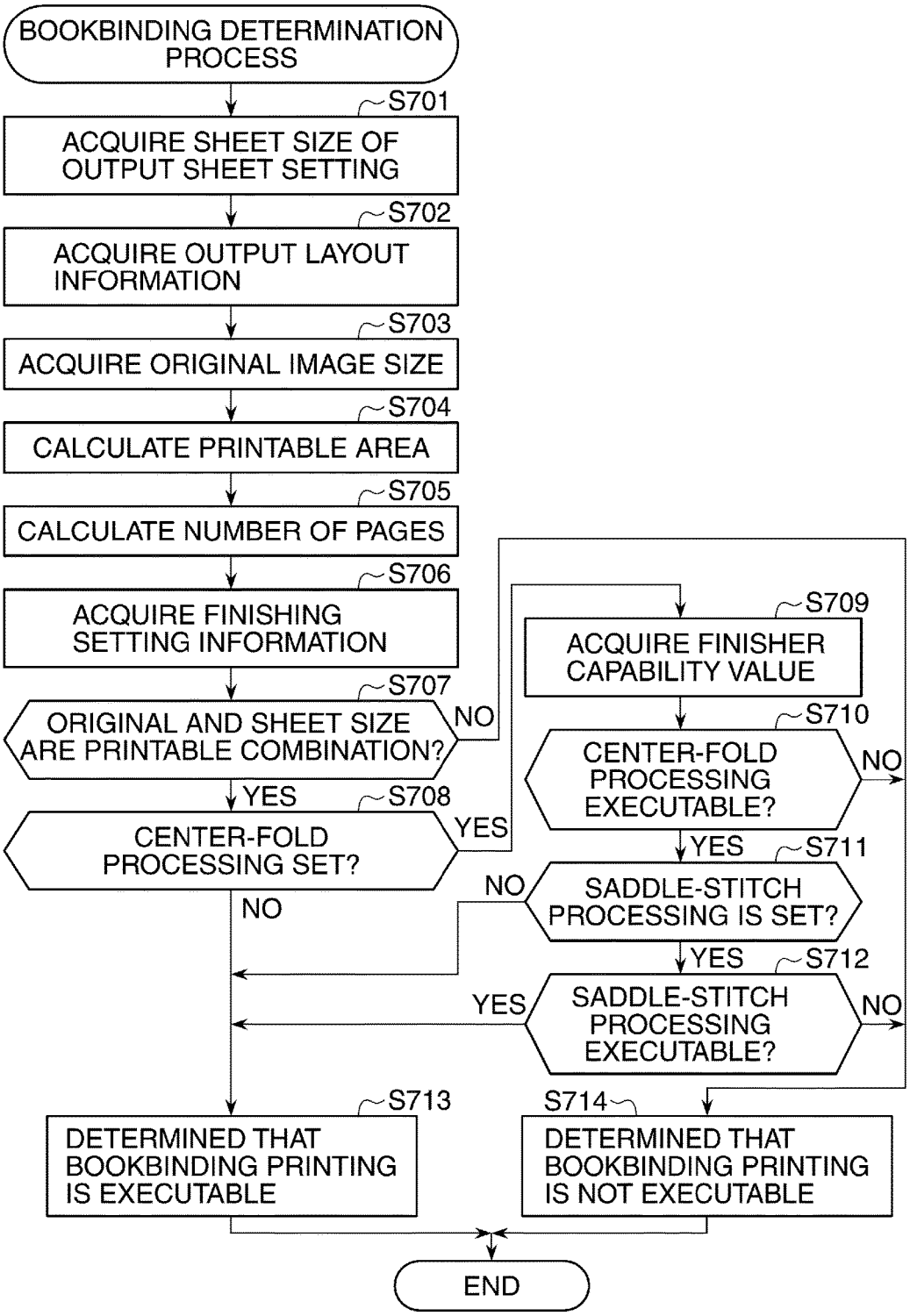
FIG. 14 is a flowchart of a bookbinding determination process executed by the CPU appearing in FIG. 8.

FIG. 14 is a flowchart of the bookbinding determination process executed by the CPU 101 appearing in FIG. 8.

In the bookbinding determination process shown in FIG. 14, the CPU 101 acquires the sheet size of the output sheet setting (step S701). Next, the CPU 101 acquires the copy settings and output layout information which have been temporarily stored (step S702). The output layout information indicates how an original image reference position is to be laid out with respect to the output sheet reference position.

Then, the CPU 101 acquires the original image size temporarily stored in the step S505 (step S703), and calculates, based on the copy settings, an original image size to be obtained after being subjected to image processing for printing. The CPU 101 temporarily stores the calculated original image size as an output-time original image size.

Next, the CPU 101 calculates a printable area based on the information acquired in the step S702 and the output-time original image size (step S704). The CPU 101 temporarily stores the calculated printable area in the RAM 102. Then, the CPU 101 calculates the number of output pages based on the output layout information, the output-time original image size, and the printable area (step S705).

Next, the CPU 101 acquires the temporarily stored finishing setting information (step S706).

The CPU 101 determines, based on the information acquired in the step S702 and the result calculated in the step S703, whether or not a combination of the original size and the sheet size is a printable combination (step S707). Although this is determined according to the setting of whether or not to perform the bookbinding imposition, which has been described in detail with reference to FIG. 10B, detailed description thereof is omitted.

If it is determined in the step S707 that the combination of the original size and the sheet size is not a printable combination (NO to the step S707), the CPU 101 determines that the bookbinding printing is not possible as a result of the bookbinding determination process (step S714). Then, the CPU 101 temporarily stores the result that the bookbinding printing is not possible, followed by terminating the present process.

On the other hand, if it is determined in the step S707 that the combination of the original size and the sheet size is a printable combination (YES to the step S707), the CPU 101 determines, based on the information acquired in the step S706, whether or not center-fold processing is set (step S708). Center-fold processing is performed according to the finishing setting of the bookbinding settings, described in detail with reference to FIG. 10B.

If it is determined in the step S708 that center-fold processing is not set (NO to the step S708), the CPU 101 determines that the bookbinding printing is executable as a result of bookbinding determination processing (step S713), and temporarily stores the result that the bookbinding printing is executable, followed by terminating the present process.

On the other hand, if it is determined in the step S708 that center-fold processing is set (YES to the step S708), the CPU 101 acquires the capability information of the finisher 109 via the accessory interface 108 (step S709). The information acquired in the step S709 includes the numbers, sizes, and types of sheets which can be subjected to center-fold processing, and further, the numbers, sizes, and types of sheets which can be subjected to saddle-stitch processing.

Next, the CPU 101 determines, based on the capability information of the finisher 109 acquired in the step S709, the number of output pages calculated in the step S709, and the output sheet information acquired in the step S701, whether or not center-fold processing is executable (step S710).

If it is determined in the step S710 that center-fold processing is not possible (NO to the step S710), the process proceeds to the step S714.

On the other hand, if it is determined in the step S710 that center-fold processing is executable (YES to the step S710), the CPU 101 determines, based on the information acquired in the step S706, whether or not saddle-stitch processing is set (step S711). Saddle-stitch processing is performed according to the finishing setting described in detail with reference to FIG. 10B.

If it is determined in the step S711 that saddle-stitch processing is not set (NO to the step S711), the CPU 101 proceeds to the step S713.

On the other hand, if it is determined in the step S711 that saddle-stitch processing is set (YES to the step S711), the CPU 101 proceeds to a step S712, wherein the CPU 101 determines, based on the capability information of the finisher 109 acquired in the step S709, the number of output pages calculated in the step S709, and the output sheet information acquired in the step S701, whether or not saddle-stitch processing is executable (step S712).

If it is determined in the step S712 that saddle-stitch processing is not possible (NO to the step S712), the CPU 101 proceeds to the step S714. On the other hand, if it is determined in the step S712 that saddle-stitch processing is executable (YES to the step S712), the CPU 101 proceeds to the step S713.

Figure 15:
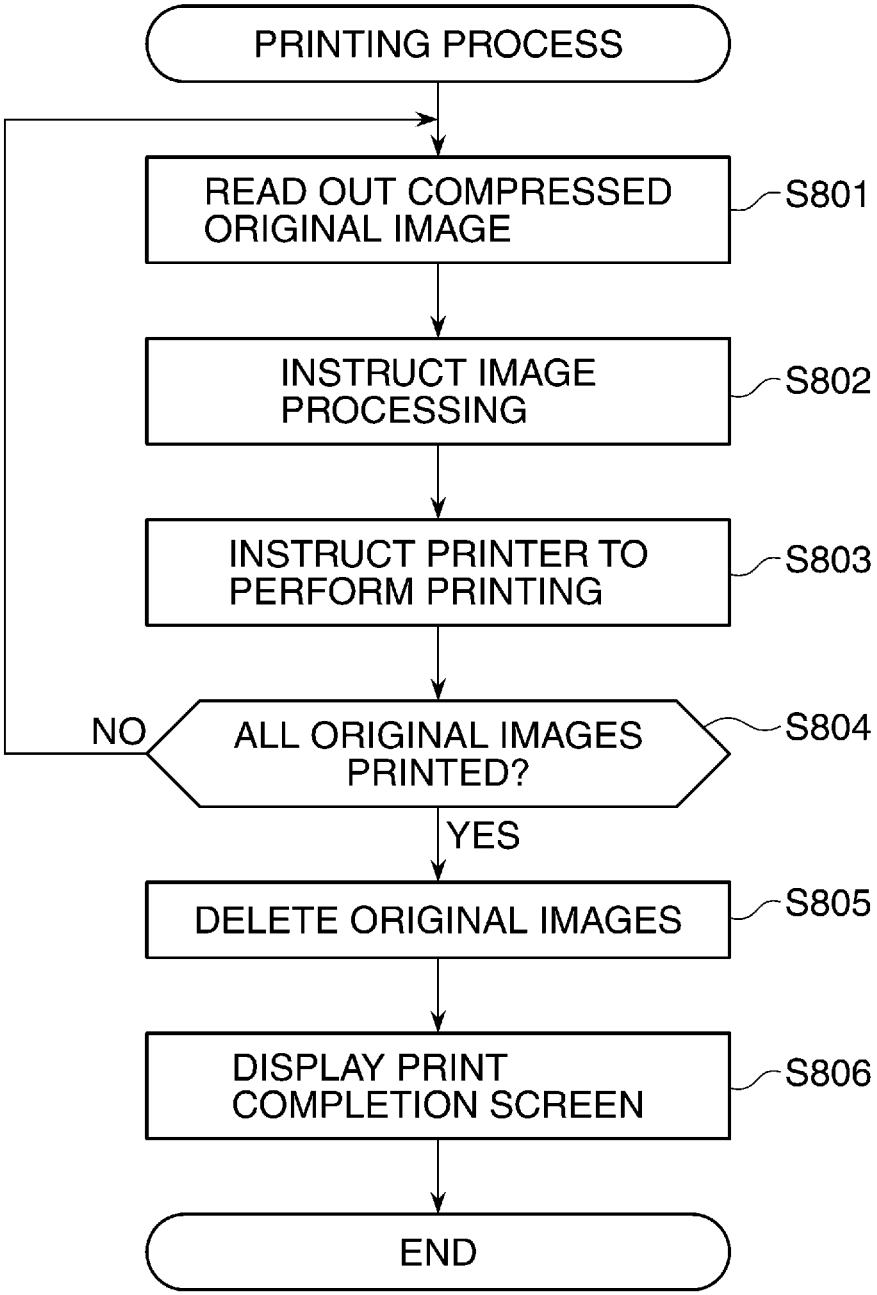
FIG. 15 is a flowchart of a printing process executed by the CPU appearing in FIG. 8.

FIG. 15 is a flowchart of the printing process executed by the CPU 101 appearing in FIG. 8.

In the printing process shown in FIG. 15, the CPU 101 reads out the compressed original image stored in the HDD 104 (step S801), and loads the read original image into the RAM 102.

When the original image has been loaded into the RAM 102, the CPU 101 instructs the image expansion section 115 to perform image processing for expanding the compressed original image loaded in the RAM 102 (step S802). Then, upon receipt of a processing completion notification from the image-editing image processing section 114, the CPU 101 proceeds to a step S803. Description of the processing performed by the image-editing image processing section 114 is omitted.

In the step S803, the CPU 101 instructs the printer engine 120 to print the original image subjected to image processing in the step S802.

Then, the CPU 101 determines whether or not all of the original images have been printed (step S804). If it is determined in the step S804 that all of the original images have not been printed (NO to the step S804), the process returns to the step S801.

On the other hand, if it is determined in the step S804 that all of the original images have been printed (YES to the step S804), the CPU 101 deletes all of the original images which have been printed in the step S803 from the RAM 102 and the HDD 104 (step S805).

Then, when all of the original images have been deleted, the CPU 101 displays a print completion screen on the console section 121 (step S806), followed by terminating the present process. When the printing process is terminated, the CPU 101 proceeds to a finishing process in FIG. 16.

Figure 16:
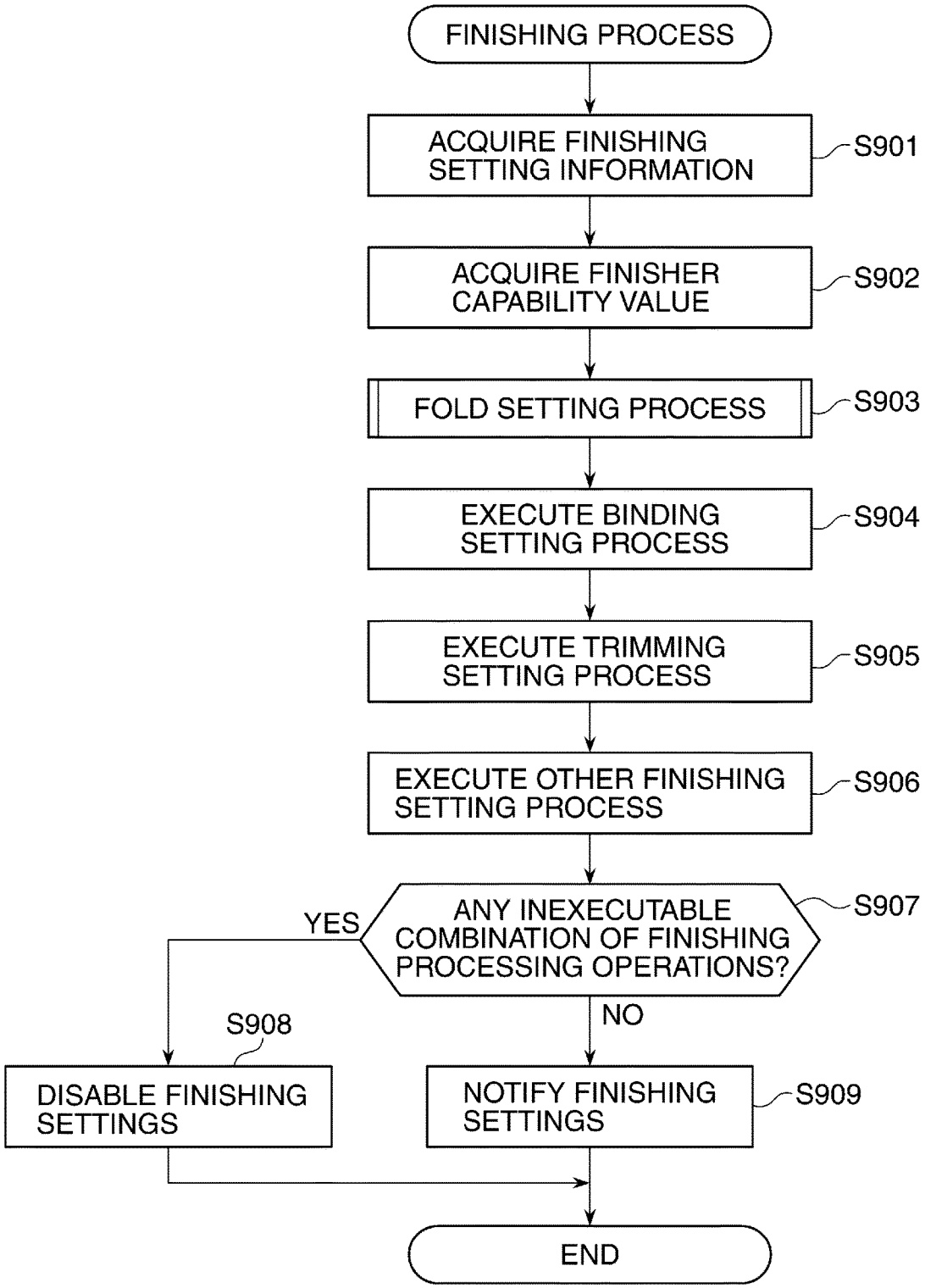
FIG. 16 is a flowchart of a finishing process executed by the CPU appearing in FIG. 8.

FIG. 16 is a flowchart of the finishing process executed by the CPU 101 appearing in FIG. 8.

In the finishing process shown in FIG. 16, the CPU 101 acquires the finishing setting information (step S901), and acquires the capability value of the finisher 109 (step S902).

Next, the CPU 101 executes a fold setting process (step S903). The fold setting process will be described in detail hereinafter with reference to the FIG. 17.

When the fold setting process is terminated, the CPU 101 executes a binding setting process (step S904). In this process, a binding type and a binding position are compared with the capability information of the finisher 109 to check whether or not binding processing can be performed, and if binding processing can be performed, binding processing is added to the finishing setting.

When the binding setting process is terminated, the CPU 101 executes a trimming setting process (step 905). In this process, a trimming type, and trimming width and height are compared with the capability information of the finisher 109 to check whether or not trimming processing can be performed, and if the trimming processing can be performed, the trimming processing is added to the finishing setting.

Then, the CPU 101 executes processing for setting other finishing settings (step S906). The other finishing settings include the setting of punching and the setting of shift discharge. In this process, a type and a set value in each of the other finishing settings are compared with the capability information of the finisher 109 to check whether or not each type of finishing processing can be performed, and if any type of finishing processing can be performed, the type of finishing processing is added to the finishing setting.

Next, the CPU 101 determines whether or not the processing operations to be executed according to the finishing settings set in the steps S903 to S906 include any combination of finishing processing operations that cannot be simultaneously performed (step S907).

The step S907 is executed to determine whether or not any types of finishing processing are set which can be each singly and separately performed but cannot be simultaneously performed.

If it is determined in the step S907 that no combination of finishing processing operations that cannot be simultaneously executed are included (NO to the step S907), the CPU 101 proceeds to a step S909, wherein the CPU 101 determines that all types of finishing processing set in the steps S903 to S906 are to be executed, and notifies the finisher 109 of the determination result via the accessory interface 108 (step S909), followed by terminating the present process. Thereafter, when the job is completed, the standby screen is displayed.

On the other hand, if it is determined in the step S907 that any combination of finishing processing operations that cannot be simultaneously executed are included (YES to the step S907), the CPU 101 proceeds to a step S908, wherein the CPU 101 disables all types of finishing processing set in the steps S903 to S906 (step S908), and deletes the temporarily stored settings of finishing processing, followed by terminating the present process.

Figure 17:
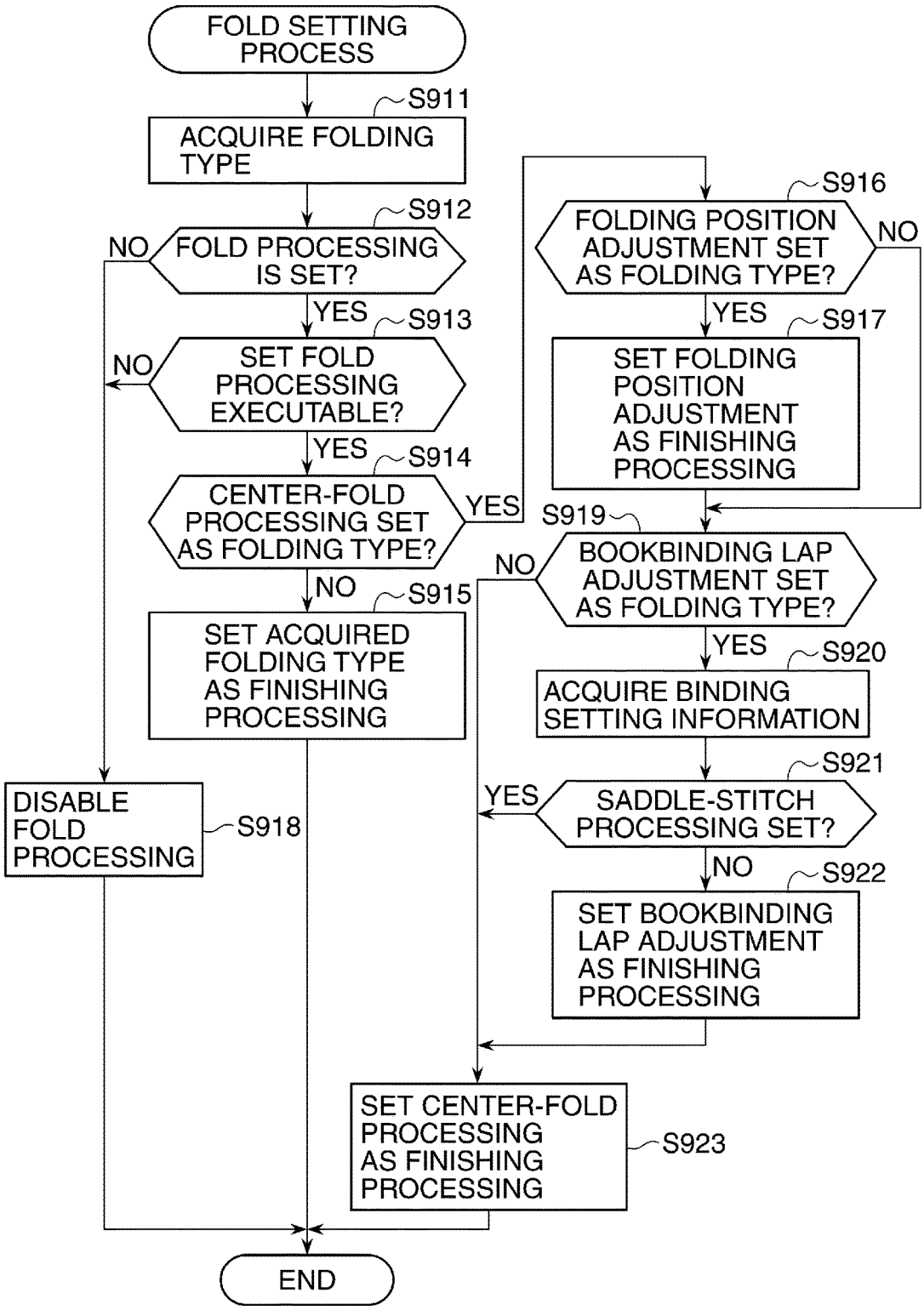
FIG. 17 is a flowchart of a fold setting process executed by the CPU appearing in FIG. 8.

FIG. 17 is a flowchart of the fold setting process executed by the CPU 101 appearing in FIG. 8.

In the fold setting process shown in FIG. 17, the CPU 101 acquires folding type information from the finishing setting information acquired in the step S901 (step S911). The folding type information also includes not only information on a folding type but also information on a folding position, a folding direction, and the number of sheets to be folded.

Next, the CPU 101 determines whether or not fold processing is set based on the information acquired in the step S911 (step S912).

If it is determined in the step S912 that fold processing is not set (NO to the step S912), the CPU 101 disables all types of fold processing (step S918), followed by terminating the present process. Note that when the present process is terminated after execution of the step S918, the setting of the fold processing which has been temporarily stored is deleted in the step S918, and then the present process is terminated.

On the other hand, if it is determined in the step S912 that fold processing is set (YES to the step S912), the CPU 101 proceeds to a step S913, wherein the CPU 101 determines, based on the folding type information acquired in the step S911 and the capability information of the finisher 109 acquired in the step S902, whether or not the set fold processing can be performed (step S913).

If it is determined in the step S913 that the set fold processing cannot be performed (NO to the step S913), the CPU 101 proceeds to the step S918.

On the other hand, if it is determined in the step S913 that the set fold processing can be performed (YES to the step S913), the CPU 101 determines whether or not center-fold processing is set as the folding type acquired in the step S911 (step S914).

If it is determined in the step S914 that center-fold processing is not set as the folding type (NO to the step S914), the CPU 101 sets the folding type acquired in the step S911 as finishing processing (step S915), followed by terminating the present process.

On the other hand, if it is determined in the step S914 that center-fold processing is set as the folding type (YES to the step S914), the CPU 101 determines whether or not the folding type acquired in the step S911 includes the setting of the folding position adjustment (step S916). The folding position adjustment has been described in detail with reference to FIG. 10F.

If it is determined in the step S916 that the folding type does not include the setting of the folding position adjustment (NO to the step S916), the CPU 101 proceeds to a step S919.

On the other hand, if it is determined in the step S916 that the folding type includes the setting of the folding position adjustment (YES to the step S916), the CPU 101 sets the folding position adjustment the setting of which is included in the folding type acquired in the step S911 as finishing processing (step S917).

Next, the CPU 101 determines whether or not the folding type acquired in the step S911 includes the setting of the bookbinding lap adjustment (step S919). The bookbinding lap adjustment has been described in detail with reference to FIG. 10E.

If it is determined in the step S919 that the folding type does not include the setting of the bookbinding lap adjustment (NO to the step S919), the CPU 101 sets center-fold processing as finishing processing (step S923), followed by terminating the present process.

On the other hand, if it is determined in the step S919 that the folding type includes the setting of the bookbinding lap adjustment (YES to the step S919), the CPU 101 acquires the binding setting from the finishing setting information acquired in the step S901 (step S920).

Next, the CPU 101 determines, based on the binding setting acquired in the step S920, whether or not saddle-stitch processing is set (step S921).

If it is determined in the step S921 that saddle-stitch processing is set (YES to the step S921), the CPU 101 proceeds to the step S923.

On the other hand, if it is determined in the step S921 that saddle-stitch processing is not set (NO to the step S921), the CPU 101 proceeds to a step S922. Then, the CPU 101 sets the bookbinding lap adjustment included in the folding type information acquired in the step S911 as finishing processing (step S922), and proceeds to the step S923.

Figure 18:
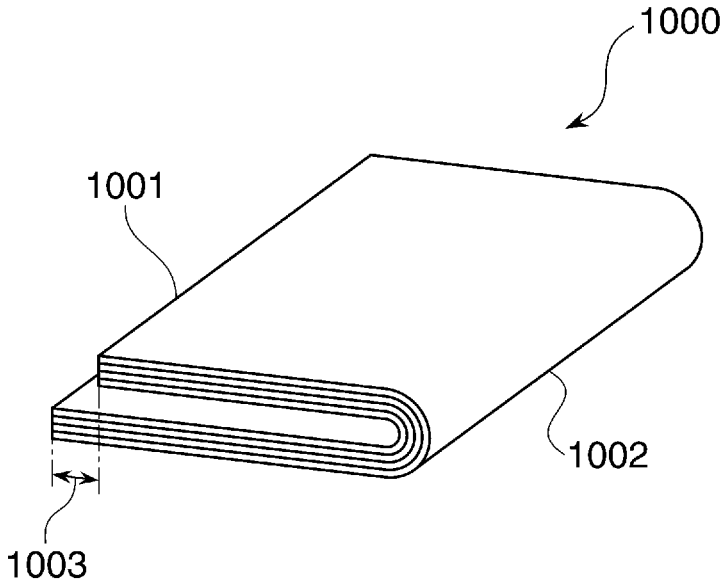
FIG. 18 is a view of an example of an output obtained when a bookbinding lap is set and processing operations up to center-fold processing have been performed by the sheet processing apparatus according to the first embodiment.

FIG. 18 is a view of an example of an output product (hereinafter referred to as the "fold section") 1000 obtained in a case where the sheet processing apparatus 90 according to the present embodiment sets a bookbinding lap and performs processing operations up to center-fold processing.

In FIG. 18, in general, a side of the fold section 1000, which is opened, is referred to as a fore edge 1001, and a side of the same, which is closed, is referred to as a back 1002. In the present embodiment, a difference in length is generated in the fore edge 1001 by setting the bookbinding lap.

The difference in length is referred to as a lap 1003. Without the lap 1003, assuming that saddle-stitch processing is to be performed by a post-processing apparatus which is a different system from the sheet processing apparatus 90, it is impossible for the system to accurately feed the fold section 1000 and place the same on a gathering chain 1101 (see FIG. 19A) in an opened state.

The fold section 1000 is saddle-stitched, singly or together with a plurality of other fold sections in a stacked state, and then is trimmed to thereby form a finished saddle-stitched book.

Figure 19B:
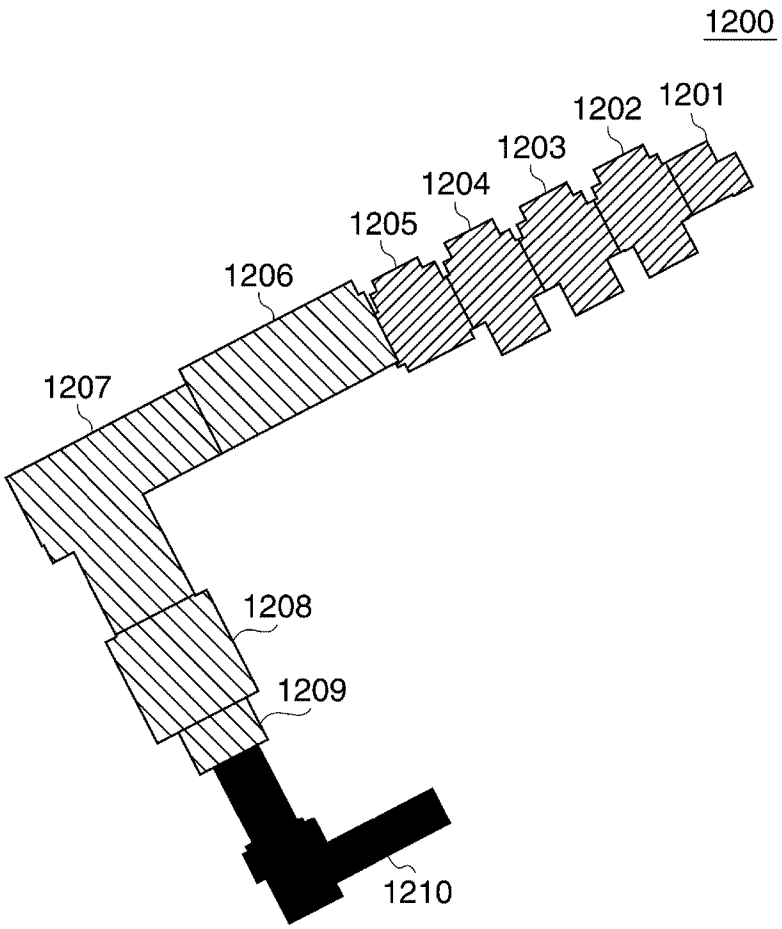
FIGS. 19A and 19B are schematic diagrams showing post-processing steps executed by a post-processing apparatus.
Figure 19A:
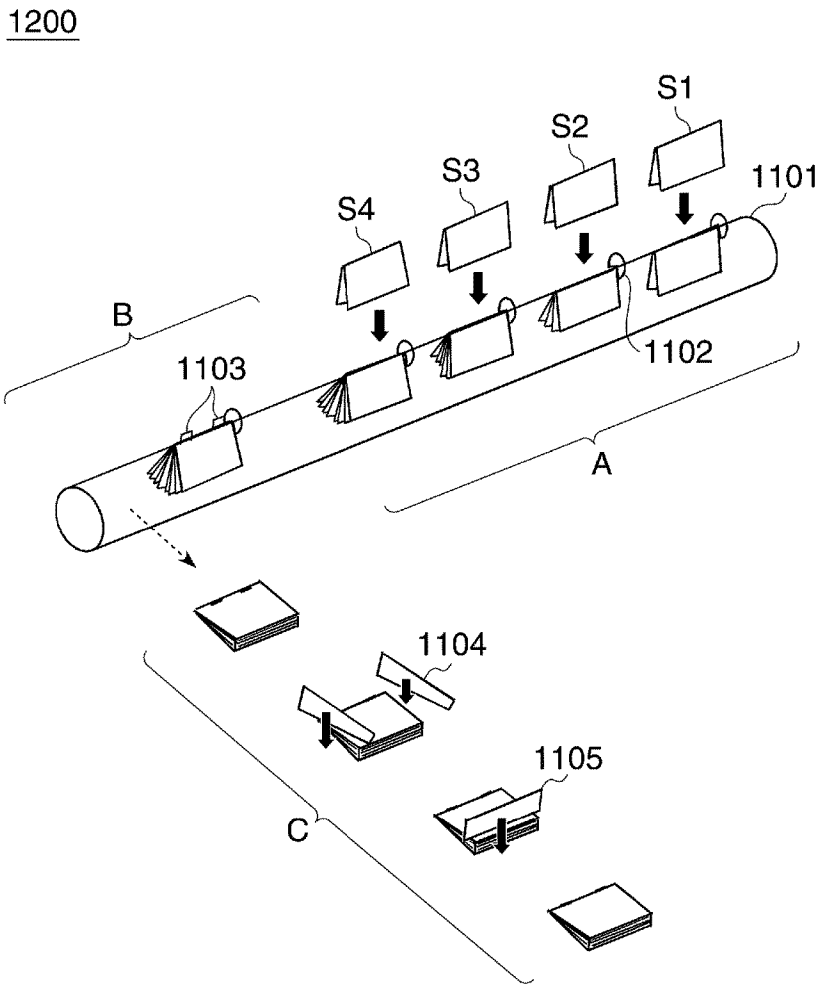

FIG. 19A is a schematic diagram showing post-processing steps executed by a post-processing apparatus 1200.

Figure 20:
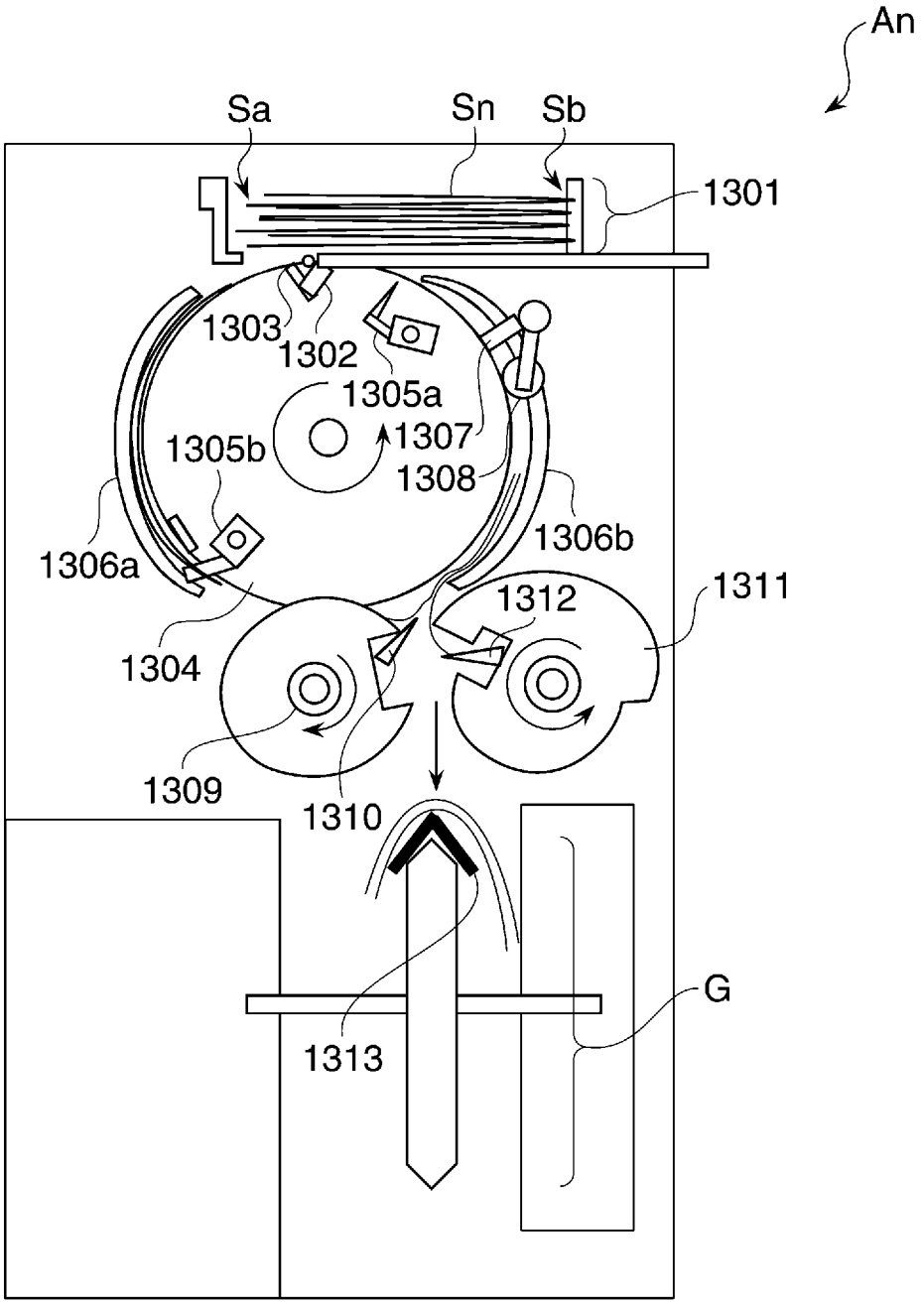
FIG. 20 is a cross-sectional view of a fold section-supplying unit appearing in FIG. 19B.

With reference to FIGS. 19A, 19B, and 20, detailed description will be given of the steps in which fold sections created according to the present embodiment are processed by the post-processing apparatus 1200 which executes saddle-stitch bookbinding processing to create a saddle-stitched book.

In FIG. 19A, S1 to S4 denote the fold sections 1000, respectively, and the names of S1 to S4 are used for the sake of explanation, in order of superposing the fold sections 1000. Further, FIG. 19A shows the conveyer (gathering chain) 1101 for conveying fold sections, a feeding lug 1102, staple wires 1103, head and foot knives 1104, and a fore edge knife 1105.

A step A is a collation step for superposing the fold sections 1000 created by the sheet processing apparatus 90 such that they can be formed into one book.

In the collation step A, the plurality of fold sections S1 to S4 which finally form one saddle-stitched book are fed onto the gathering chain 1101 one by one in a state in which the fore edge 1001 is opened. The fed fold sections are aligned by the feeding lug 1102 and collated.

The next step B is a saddle-stitching step for saddle-stitching the fold sections in the middle, which have been superposed in the step A, to thereby make a saddle-stitched book.

In the saddle-stitching step B, a collection of the fold sections aligned and superposed in the step A is stitched with the staple wires 1103.

The next step C is a trimming step for shaping the book by trimming the head and foot and the fore edge of the saddle-stitched book created in the step B.

In the trimming step C, the collection of fold sections stitched in the preceding step B has its head and foot trimmed by the head and foot knives 1104, and has its fore edge trimmed by the fore edge knife 1105.

Thus, the fold sections 1000 created according to the present embodiment are formed into saddle-stitched books which are by the above-described saddle-stitch processing steps, and the books thus finished are accumulated.

The above-described steps executed by the post-processing apparatus 1200 form the fold sections 1000 into finished saddle-stitched books subjected to saddle-stitch processing and trimming processing. Hereafter, the steps will be more specifically described with reference to figures. Note that the post-processing apparatus 1200 is described only by way of example, and the present embodiment is not limited to the post-processing apparatus having a mechanism shown in this example, but can be applied to a post-processing apparatus which is capable of creating the fold sections 1000 effective to all post-processing apparatuses which handle the fold section 1000 having a lap.

FIG. 19B is an overhead view of the post-processing apparatus 1200 shown in FIG. 19A.

In FIG. 19B, the post-processing apparatus 1200 includes a gathering chain controller 1201, fold section-supplying units 1202 to 1204, a cover supplying unit 1205, and a central control unit 1206. The post-processing apparatus 1200 further includes a saddle-stitching unit 1207, a trimming unit 1208, a trimming conveyer table 1209, and an automatic accumulation unit 1210.

The gathering chain controller 1201 and the fold section-supplying units 1202 to 1204 are used in the collation step A described with reference to FIG. 19A. The saddle-stitching unit 1207 is used in the saddle-stitching step B described with reference to FIG. 19A. The trimming unit 1208 and the trimming conveyer table 1209 are used in the trimming step C described with reference to FIG. 19A. Hereafter, the respective units will be described in detail.

The gathering chain controller 1201 controls turning of the gathering chain 1101. A pathway to the central control unit 1206 is connected by the same gathering chain 1101, and the fold section-supplying units 1202 to 1204 and the cover supplying unit 1205 are arranged on the pathway.

The fold section-supplying units 1202 to 1204 feed the fold sections indicated by S1 to S3 in FIG. 19A onto the gathering chain 1101, respectively. The operations of the fold section-supplying units 1202 to 1204 are controlled by the central control unit 1206, and each fold section is fed in proper timing in synchronism with fold sections, if any, being conveyed on the gathering chain 1101, and is superposed onto the conveyed fold sections.

The cover supplying unit 1205 supplies the fold section indicated by S4 in FIG. 19A on the gathering chain 1101. This fold section forms a cover when a saddle-stitched book is finished, and is collated at the end of the collation step.

The central control unit 1206 controls the overall operation of the post-processing apparatus 1200. The central control unit 1206 includes a user interface, such as a touch screen operation panel, and the operator can perform centralized control of the entire saddle-stitching unit by operating the user interface.

The operator inputs dimensions of the fold section before trimming, and the head and foot, and fore edge of the trimmed fold section, a thickness of a finished saddle-stitched book, and so on. In accordance with the input, the settings for all of the steps using the fold section-supplying units 1202 to 1204, the cover supplying unit 1205, the saddle-stitching unit 1207, the trimming unit 1208, the trimming conveyer table 1209, and the automatic accumulation unit 1210 are automatically configured.

Further, the timing between the operations performed by the fold section-supplying units 1202 to 1204 and the gathering chain 1101, and the timing between the operations performed by the gathering chain 1101 and the saddle-stitching unit 1207 are automatically synchronized. The length of staple wires delivered by the saddle-stitching unit 1207 is also automatically adjusted in accordance with the thickness of the fold sections.

The saddle-stitching unit 1207 executes the saddle-stitching step B for stitching a collection of collated fold sections with the staple wires 1103. The saddle-stitching unit 1207 receives the settings of the thickness of fold sections to be stitched, stitching points, stitching pressure, and so on from the central control unit 1206. Further, usually, the saddle-stitching unit 1207 can be used as a single unit, and these settings can be input from the saddle-stitching unit 1207 itself.

The trimming unit 1208 executes the trimming step C for trimming the fore edge of a saddle-stitched book, and at the same time trimming the head and foot of the same. Trimmed waste generated during the trimming operation is collected in a collection container, not shown. The trimming unit 1208 receives the settings of the thickness of the fold sections to be trimmed, the width of the fore edge and the head and foot of a finished book, and so on, from the central control unit 1206. Usually, these settings can also be input from the trimming unit 1208 itself, similarly to the saddle-stitching unit 1207.

The trimming conveyer table 1209 performs conveyance of the fold sections before and after trimming. The trimming conveyer table 1209 performs processing for stopping conveyance of the fold sections at the moment of trimming so as to prevent the fold sections from being damaged during trimming, and for conveying the trimmed fold sections to the automatic accumulation unit 1210. The automatic accumulation unit 1210 accumulates the finished saddle-stitched books by changing the orientation of saddle-stitched books, alternately, for each specified number of copies.

FIG. 20 is a cross-sectional view of each of the fold section-supplying units 1202 to 1204 appearing in FIG. 19B.

In FIG. 20, the fold section-supplying units 1202 to 1204 disposed above the gathering chain are denoted by A1, A2, . . . , starting with the one closest to the gathering chain control unit 1201.

Further, the fold section-supplying unit described with reference to FIG. 20 is generally denoted by An, an associated fold section is generally denoted by Sn, the fore edge 1001 and the back of the fold section Sn are denoted by Sa and Sb, respectively. A cross section of the gathering chain 1101 is denoted by G.

Further, FIG. 20 illustrates a fold section accumulation section 1301, a sucker 1302, a suction cup 1303, an upper cylinder 1304, grippers 1305*a*, 1305*b* of the upper cylinder 1304, and upper cylinder guides 1306*a*, 1306*b*. FIG. 20 further illustrates a stopper 1307, a counter-rotating roller 1308, a lap cylinder 1309, a gripper 1310 of the lap cylinder 1309, an opening cylinder 1311, a gripper 1312 of the opening cylinder 1311, and a guide 1313.

In FIG. 20, the fold section-supplying unit 1202 has fold sections stacked on the fold section accumulation section 1301 in a block. The fold sections are each accumulated such that an advanced fore edge side of the fore edge Sa (which includes, at this processing stage, advanced and withdrawn fore edge portions of sheets) is on a bottom side. The step for supplying the fold sections onto the gathering chain 1101 one by one from the collection of the stacked fold sections Sn will be described.

First, the sucker 1302 draws out each fold section Sn by hooking the back Sb using the suction cup 1303 included therein, and the gripper 1305*a* or 1305*b* of the upper cylinder 1304 draws out the fold sections Sn one by one.

The fold section Sn which has been drawn out is rotated in a manner setting the back Sb as a leading end, and is conveyed between the upper cylinder guides 1306*a* and 1306*b* and a peripheral surface of the upper cylinder 1304 until the fold section Sn is brought into abutment with the stopper 1307, with the advanced fore edge portion side of the fore edge Sa positioned outside, and the withdrawn fore edge portion side of the fore edge Sa positioned inside.

As soon as the fold section Sn is brought into abutment with the stopper 1307, the gripper 1305 is opened, and the counter-rotating roller 1308 removes the fold section Sn from the gripper 1305 to thereby case the fold section Sn to drop downward along the upper cylinder guide 1306.

When the fold section Sn is dropped down, the gripper 1310 of the lap cylinder 1309 grips the withdrawn fore edge portion of the fore edge Sa of the fold section Sn, and the gripper 1312 of the opening cylinder 1311 grips the withdrawn fore edge portion of the fore edge Sa of the fold section Sn.

The lap cylinder 1309 and the opening cylinder 1311 are rotated in an opposite direction, and hence the fold section Sn is opened horizontally. Then, the opened fold section Sn drops in a direction indicated by an arrow. The fold section Sn which has dropped is put on the guide 1313 of the gathering chain 1101 which collects and conveys the fold sections S (S1 to Sn−1) dropped from the fold section-supplying units A (A1 to An−1).

Then, the fold sections S placed on the guide 1313 of the gathering chain 1101 are held by the feeding lug 1102 which is on a side toward the gathering chain controller 1201, and are conveyed forward in a state placed on the guide 1313 of the gathering chain 1101.

The fold sections S are thus sequentially dropped and are conveyed such that a following one is superposed on the preceding one, and are collated as described above.

In the above-described fold section-supplying units 1202 to 1204, the gripper 1310 of the lap cylinder 1309 and the gripper 1312 of the opening cylinder 1311 appear when gripping the withdraw fore edge portion and the advanced fore edge portion of the fore edge Sa, respectively.

That is, if the fore edge Sa has no lap, or is smaller than required by the fold section-supplying units 1202 to 1204, each gripper cannot properly grip the edge.

As described above, in the saddle-stitched bookbinding printing, in the case where the processing operations up to center-fold processing are performed by the sheet processing apparatus 90, and saddle-stitch processing is performed using another system, a lap is required which is different depending on a system which performs saddle-stitch bookbinding processing.

In the present embodiment, the operator can specify the lap to be created in center-fold processing.

Therefore, the sheet processing apparatus 90 can produce center-folded print products adapted to systems which perform every type of saddle-stitch bookbinding processing, and enhance cooperation with these systems, to thereby make it possible to improve productivity in creating saddle-stitched books.

Further, it is possible to prevent a center-folded print product from being created which is unsuitable for a center-folding system, whereby it is possible to reduce wasted print products.

Although in the present embodiment, the description has been given of bookbinding printing processing using the copy function, by way of example, the present embodiment can also be applied to a case using a print function.

Next, a second embodiment of the present invention will be described. The sheet processing apparatus 90 according to the second embodiment has the same configuration and software module configuration as the sheet processing apparatus 90 according to the first embodiment.

In the first embodiment, the description has been given of the operation of the CPU 101 for creating a lap by shifting a folding position, which is set to the finisher 109 via the accessory interface 108, in center-fold processing executed when the operator has set the lap in the bookbinding lap adjustment shown in FIG. 10E.

In the first embodiment, the operator is required to perform adjustment using e.g. the print position adjustment described with reference to FIG. 10D such that the position of an image is correctly set with respect to a folding position according to a shift amount of the folding position.

In the second embodiment, the print position adjustment which is required when the folding position is shifted by the bookbinding lap adjustment is automatically performed by the CPU 101 and the printer image processing section 118 such that an image is properly positioned.

In the second embodiment, similarly to the first embodiment, upon receipt of selection of the copy function, the standby screen is displayed on the console section 121, and the waiting-time process shown in FIG. 11 is executed.

Further, similarly to the first embodiment, the scanning process in FIG. 12 is executed when the CPU 101 determines in the step S419 in FIG. 11 that the copy start button has been operated on the console section 121.

Figure 21A:
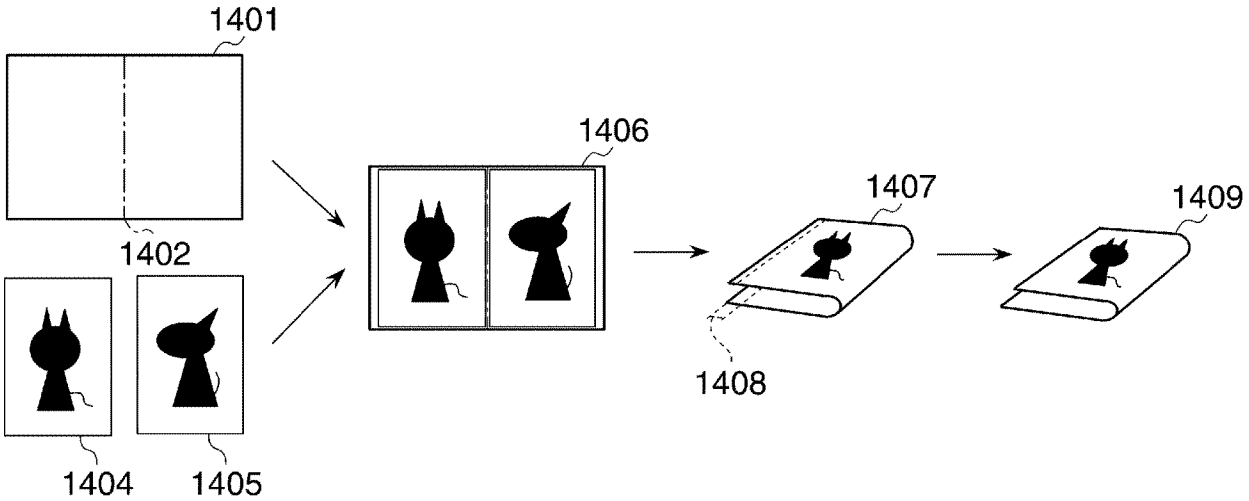
FIGS. 21A and 21B are diagrams useful in explaining automatic print adjustment performed in accordance with bookbinding lap adjustment, by a sheet processing apparatus according to a second embodiment of the present invention.
Figure 21B:
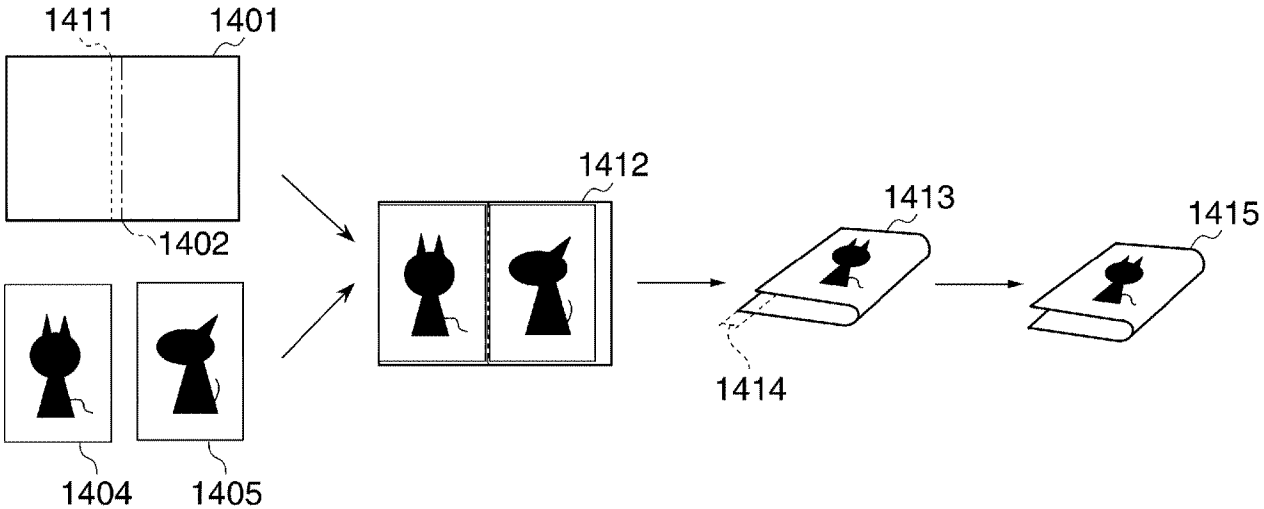

FIGS. 21A and 21B are diagrams useful in explaining automatic print adjustment performed in accordance with the bookbinding lap adjustment.

FIGS. 21A and 21B show imposition positions arranged when images 1404 and 1405 of two pages are imposed on a surface of a sheet 1401.

FIG. 21A shows an example of an output product obtained when the bookbinding lap adjustment has not been performed.

In a case where the print position adjustment value is not specified by the operator according to the print position adjustment described with reference to FIG. 10D, the images 1404 and 1405 of two pages are imposed with a centerline 1402 of the sheet 1401 positioned in the center, as indicated by an imposed image example 1406.

Since the bookbinding lap adjustment is not performed, the folding position at which center-fold processing is to be performed is along the centerline 1402 of the sheet 1401.

Usually, the images on two pages are reduced in size with respect to a sheet, or the images are provided with an area (margin) which is not important in printing. Therefore, when two pages are printed along the centerline 1402, part which is not printed is formed on a fore edge side, or the area which is unimportant is printed on the fore edge side.

This part which is not printed or the unimportant area corresponds to a trim width 1408 on the fore edge side, and the area of the trim width 1408 is cut off by edge trimming in the trimming step C, whereby a final product 1409 has no margin.

FIG. 21B shows an example of an output product obtained when the bookbinding lap adjustment has been performed according to the second embodiment.

In the case where the bookbinding lap adjustment has been performed, a folding position 1411 at which center-fold processing is to be performed is shifted from the centerline 1402 of the sheet 1401 by the bookbinding lap adjustment value.

Therefore, if the print position adjustment is not performed, the images 1404 and 1405 of two pages imposed along the centerline 1402 are not printed at correct locations with respect to the folding position 1411, and further, important part of the images is sometimes cut off in the trimming step.

To solve this problem, in the second embodiment, the print position adjustment is automatically performed when performing the bookbinding lap adjustment such that images are imposed along the folding position as illustrated in an imposed image 1412.

In the case of a print product 1413 created according to the second embodiment, an advanced fore edge portion formed according to the lap includes a larger part which is not printed or unimportant. The larger part which is not printed or unimportant corresponds to a trim width 1414 on the fore edge side.

The part of the trim width 1414 is cut off by edge trimming in the trimming step C, whereby a final product 1415 has no margin.

Figure 22:
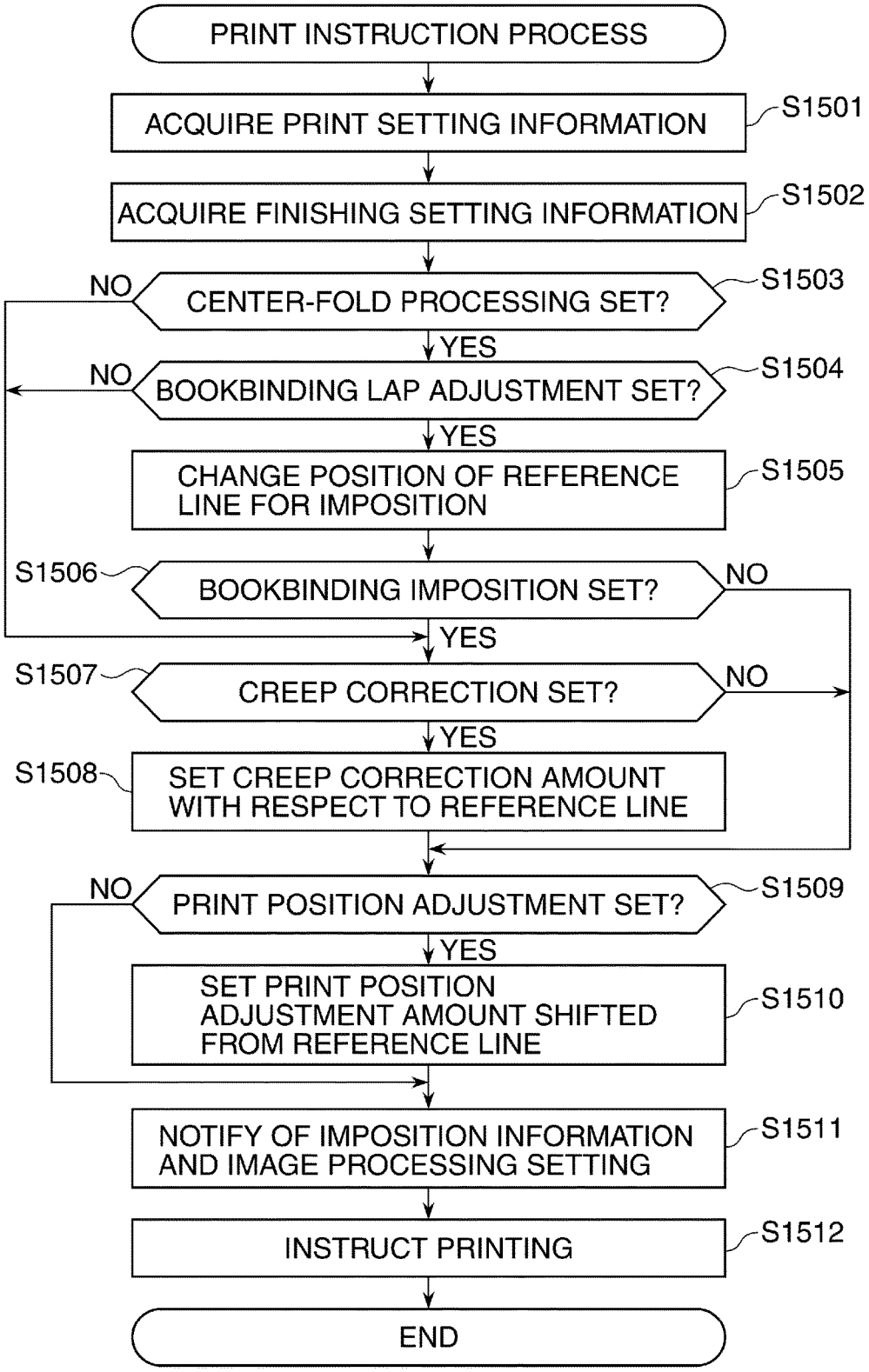
FIG. 22 is a flowchart of a print instruction process executed in the second embodiment by the CPU appearing in FIG. 8.

FIG. 22 is a flowchart of a print instruction process executed by the CPU 101 appearing in FIG. 8.

The process in FIG. 22 is the process for instructing the printer engine 120 to perform printing, which is executed in the step S803 in the printing process in FIG. 15.

The CPU 101 acquires print setting information (step S1501), and acquires finishing setting information (step S1502).

Next, the CPU 101 determines, based on the finishing setting information acquired in the step S1502, whether or not center-fold processing is set (step S1503). If it is determined in the step S1503 that center-fold processing is not set (NO to the step S1503), the CPU 101 proceeds to a step S1507.

On the other hand, if it is determined in the step S1503 that center-fold processing is set (YES to the step S1503), the CPU 101 determines, based on the print setting information acquired in the step S1501, whether or not the bookbinding lap adjustment is set (step S1504).

If it is determined in the step S1504 that the bookbinding lap adjustment is not set (NO to the step S1504), the CPU 101 proceeds to the step S1507.

On the other hand, if it is determined in the step S1504 that the bookbinding lap adjustment is set (YES to the step S1504), the CPU 101 proceeds to a step S1505. The CPU 101 reads out the bookbinding lap adjustment amount from the print setting information acquired in the step S1501, and changes the position of an imposition reference line with reference to which the position of each image is set for imposition (step S1505). The change of the position of the imposition reference line will be described hereinafter with reference to FIGS. 23A to 23C. Further, note that in the second embodiment, an initial position of the reference line is set to the centerline 1402 of the sheet.

Next, the CPU 101 determines, based on the print setting information acquired in the step S1501, whether or not the bookbinding imposition is set (step S1506). The bookbinding imposition setting has been described in detail with reference to FIG. 10B.

If it is determined in the step S1506 that the bookbinding imposition is not set (NO to the step S1506), the CPU 101 proceeds to a step S1509. On the other hand, if it is determined in the step S1506 that the bookbinding imposition is set (YES to the step S1506), the CPU 101 determines, based on the print setting information acquired in the step S1501, whether or not the creep correction is set (step S1507).

If it is determined in the step S1507 that the creep correction is not set (NO to the step S1507), the CPU 101 proceeds to the step S1509. On the other hand, if it is determined in the step S1507 that the creep correction is set (YES to the step S1507), the CPU 101 reads out a creep correction amount from the print setting information acquired in the step S1501, and sets the creep correction amount with respect to the reference line (step S1508). This setting will also be described hereinafter with reference to FIGS. 23A to 23C.

Next, the CPU 101 determines, based on the print setting information acquired in the step S1501, whether or not the print position adjustment is set (step S1509). If it is determined in the step S1509 that the print position adjustment is not set (NO to the step S1509), the CPU 101 proceeds to a step S1511.

On the other hand, if it is determined in the step S1509 that print position adjustment is set (YES to the step S1509), the CPU 101 proceeds to a step S1510. The CPU 101 reads out a print position adjustment value from the print setting information read in the step S1501, and sets the print position adjustment amount shifted from the reference line (step S1510). This setting will also be described hereinafter with reference to FIGS. 23A to 23C.

Next, the CPU 101 notifies the printer image processing section 118 of the print setting information acquired in the step S1501 and imposition information which is a calculation result of the sum of the amounts of adjustment of the image position from the initial value of the reference line (i.e. the centerline 1402), which have been calculated in the steps S1503 to S1510. That is, the CPU 101 notifies the printer image processing section 118 of the imposition information and the print setting information (step S1511).

Then, the CPU 101 instructs the printer engine 120 to perform printing via the printer image processing section 118 (step S1512), followed by terminating the present process. Printing processing and finishing processing after providing the print instruction are executed similarly to the first embodiment.

Figure 23A:
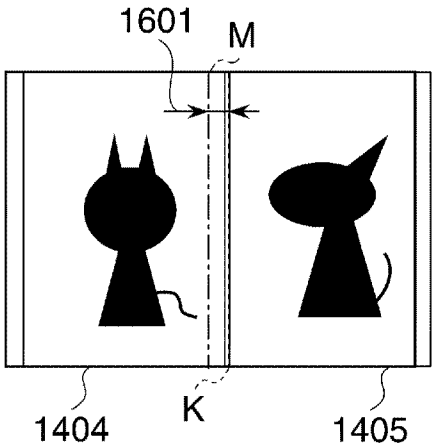
FIG. 23A is a diagram useful in explaining a change of an imposition reference position calculated by the CPU in a step in the print instruction process shown in FIG. 22.
Figure 23B:
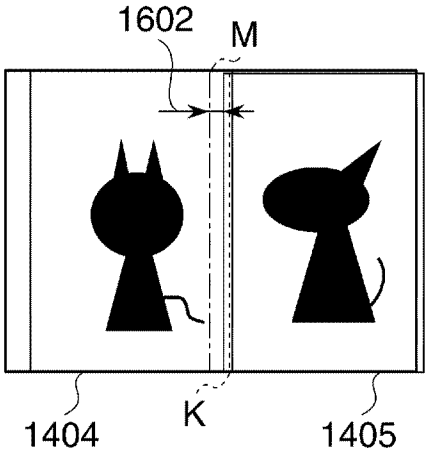
FIG. 23B is a diagram useful in explaining a creep correction amount calculated by the CPU in a step in the print instruction process shown in FIG. 22.
Figure 23C:
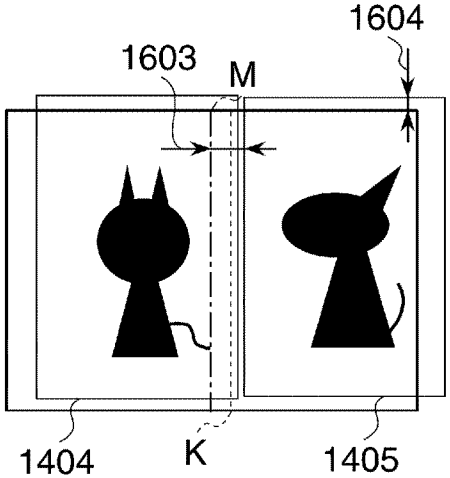
FIG. 23C is a diagram useful in explaining a print position adjustment amount calculated by the CPU in a step in the print instruction process shown in FIG. 22.

FIGS. 23A to 23C are diagrams useful in explaining a change of the imposition reference position, the creep correction amount, and the print position adjustment amount, which are calculated by the CPU 101 in the steps S1505, S1508, and S1510 in FIG. 22, respectively.

In FIGS. 23A to 23C, M denotes the centerline 1402, and K denotes the reference line of the image position. It is assumed that the sheet and the imposed images are folded in a manner facing outward in folding processing.

FIG. 23A is the diagram useful in explaining the change of the imposition reference position. A displacement 1601 between the reference line K and the centerline M, calculated in the step S1505, is equal to an amount of the bookbinding lap adjustment set in FIG. 10E.

Assuming that the set bookbinding lap is X, the positive direction in FIGS. 23A to 23C is a right direction, and hence the reference line of the image position is shifted by (X, 0). Therefore, respective displacements between the images 1404 and 1405, and the image position before changing the reference position are both expressed by (X, 0). When the creep correction is not performed, in a case where the reference line is not on the centerline, the printer engine 120 forms the images in such a manner that the image forming position is shifted from the position where the images are formed when the folding line is on the centerline, by the bookbinding lap X.

FIG. 23B is a diagram useful in explaining a displacement 1602 of the image imposition position from the centerline, calculated when the creep correction amount is further set after the imposition reference position has been changed.

The creep correction is a function for performing printing such that the width of images of two pages to be printed on a side of a sheet is made narrower than the width of those to be printed on a side of an outer sheet because an inner sheet protrudes outside by an amount corresponding to the thickness of sheets when the center-folding processing is performed as described above.

Therefore, in a case where the creep correction amount set to the sheet is calculated as "a" according to the creep correction amount set in FIG. 10A, a displacement in image position between the left image 1404 and the image before the change of the reference position and the creep correction is expressed by (X+a, 0). Further, a displacement in image position between the right image 1405 and the image before the change of the reference position and the creep correction is expressed by (X−a, 0).

As described above, in the case where the reference line is not on the centerline and an image is formed after performing the creep correction, the printer engine 120 forms the image at a position shifted from a position where the image is formed when the folding line is on the centerline, by the bookbinding lap, and further shifted by the creep correction amount. In the case of FIG. 23B, the positions set after the creep correction are expressed by (X+a, 0) and (X−a, 0).

FIG. 23C is the diagram useful in explaining a displacement 1603 of the image imposition position from the centerline in the horizontal direction and a displacement 1604 of the same in the vertical direction, calculated when the imposition reference position has been changed and further the print position is set.

The print position adjustment is a function for vertically and horizontally adjusting the print position, and is set by the operator using the screen shown in FIG. 10D. The print position adjustment for shifting the position upward is performed by setting a positive value for a vertical direction and the print position adjustment for shifting the position to the right is performed by setting a positive value for a horizontal direction. The set value for the horizontal direction is represented by "x", and the set value for the vertical direction is represented by "y".

At this time, the displacements in position between the images 1404 and 1405, and the images before the change of the reference position and the print position adjustment are both expressed by (X+x, y).

Note that the folding position fine adjustment described with reference to FIG. 10F is for finely adjusting a folding position in a case where the folding position on a sheet is displaced, and hence the folding position fine adjustment is not taken into consideration in determining the print position of an image.

As described above, when the bookbinding lap adjustment is set, the imposition reference line is changed based on the set bookbinding lap adjustment value, which enables the sheet processing apparatus 90 to automatically shift the image imposition position to a correct position with respect to the folding position.

This makes it possible to reduce time and effort of the operator for manually setting a print position by an amount of displacement of the folding position.

Further, although in the present embodiment, the description has been given of an example in which assuming that the set bookbinding lap is represented by X, the reference line K of the image position is shifted by (X, 0), this is not limitative, but the reference line K of the image position may be shifted by (X/2, 0). By shifting the reference line K of the image position, it is possible to adjust the reference line K of the image position to the center of an area exclusive of the bookbinding lap. With this, when the sheet is folded in two, as shown in FIG. 18, the fold line of the folded sheet and the center of images formed on the sheet are aligned with each other, which improves the appearance of images after the part of the trim width 1414 of the sheet is trimmed off.

Although the description has been mainly given of the case where imposition is performed by the sheet processing apparatus 90, the second embodiment can also be applied to a case where images subjected to imposition are printed. Further, the second embodiment can be practiced in combination with the first embodiment. Further, the second embodiment can be executed not only for a copy job, but also similarly for a print job.

Next, a third embodiment of the present invention will be described. The sheet processing apparatus 90 according to the third embodiment has the same configuration and software module configuration as the sheet processing apparatus 90 according to the first and second embodiments.

In the first and second embodiments, in the system which performs saddle-stitch processing on the fold sections 1000 created by the sheet processing apparatus 90, the operator is required to set a necessary bookbinding lap from the bookbinding lap adjustment screen 350 whenever center-fold processing is performed.

In the third embodiment, the sheet processing apparatus 90 sets a bookbinding lap required by each system which performs saddle-stitch processing (hereinafter referred to as the saddle-stitch processing apparatus).

More specifically, when the saddle-stitch processing apparatus is connected to the sheet processing apparatus 90, the CPU 101 recognizes the type of the connected saddle-stitch processing apparatus via the accessory interface 108.

On the other hand, when no saddle-stitch processing apparatus is connected to the sheet processing apparatus 90, the CPU 101 recognizes type information for identifying a saddle-stitch processing apparatus from setting information of saddle-stitch processing apparatuses, which has been registered from a registration screen for registering saddle-stitch processing apparatuses.

The type of a saddle-stitch processing apparatus is thus recognized, and the CPU 101 automatically applies the bookbinding lap required by the saddle-stitch processing apparatus of the recognized type from a database connected through a network via the LAN 122 or a database included in the HDD 104 to thereby set the necessary lap.

In the third embodiment, the waiting-time process in FIG. 11 is executed similarly to the first and second embodiments. The subsequent scanning process in FIG. 12, the output sheet-setting process in FIG. 13, the bookbinding determination process in FIG. 14, and the finishing process in FIG. 16 are executed similarly to the first embodiment.

Figure 24:
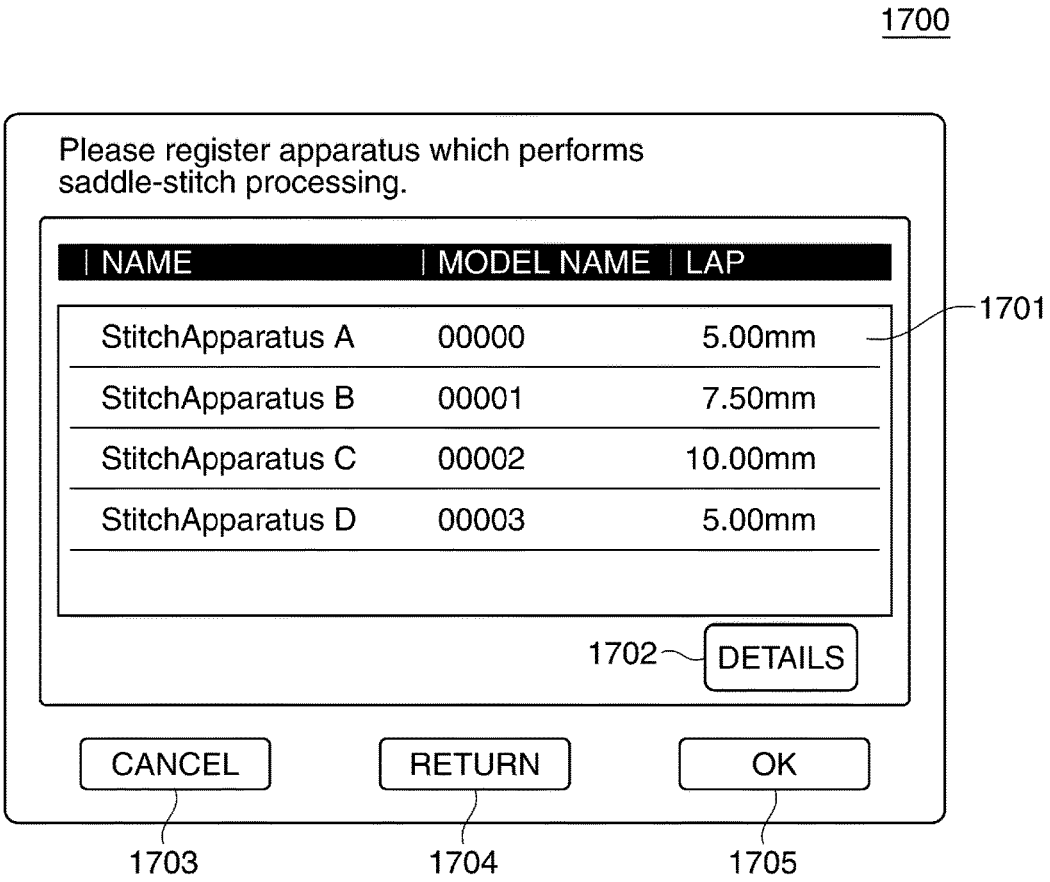
FIG. 24 is a diagram showing a saddle-stitch processing apparatus registration screen used in a third embodiment of the present invention, for registering a device that performs saddle-stitch processing.

FIG. 24 is a diagram showing a saddle-stitch processing apparatus registration screen 1700 used for registering an apparatus which performs saddle-stitch processing.

As shown in FIG. 24, by registering a saddle-stitch processing apparatus in the sheet processing apparatus 90 after creating the fold sections 1000, the sheet processing apparatus 90 can automatically set a necessary lap without inputting a lap necessary for the bookbinding lap adjustment by the operator.

In FIG. 24, a saddle-stitch processing apparatus selection button 1701 is used for selecting a saddle-stitch processing apparatus to be registered. A name, a model name, and a necessary lap of a saddle-stitch processing apparatus are displayed on saddle-stitch processing apparatus selection button 1701. A saddle-stitch processing apparatus selected by the operator is highlighted.

A details button 1702 can be selected only in a state where a saddle-stitch processing apparatus selection button 1701 has been selected, and cannot be selected in a state where no saddle-stitch processing apparatus selection button 1701 has been selected.

When the operator operates the details button 1702 in the selectable state, a saddle-stitch processing apparatus detail screen, not shown, for displaying saddle-stitch processing apparatus information which is information on the saddle-stitch processing apparatus selected at that time is displayed.

The saddle-stitch processing apparatus detail screen displays saddle-stitch processing apparatus information items stored in the HDD 104 in association with respective saddle-stitch processing apparatuses, and the operator can change the registered saddle-stitch processing apparatus information by operating the console section 121 as required.

A cancel button 1703 is used for aborting the saddle-stitch processing apparatus registration. When the operator operates the cancel button 1703, the temporarily stored registration of a saddle-stitch processing apparatus is abandoned, and the standby screen, not shown, is displayed.

A return button 1704 is used for terminating saddle-stitch processing apparatus registration. When the operator operates the return button 1704, the standby screen is displayed without registering a saddle-stitch processing apparatus.

An OK button 1705 is used for completing the saddle-stitch processing apparatus registration. When the operator operates the OK button 1705, a saddle-stitch processing apparatus is registered, and the standby screen is displayed.

The operator can operate the OK button 1705 only when one of saddle-stitch processing apparatuses is selected using the saddle-stitch processing apparatus selection button 1701. When no saddle-stitch processing apparatus is selected, the OK button 1705 cannot be operated.

Figure 25:
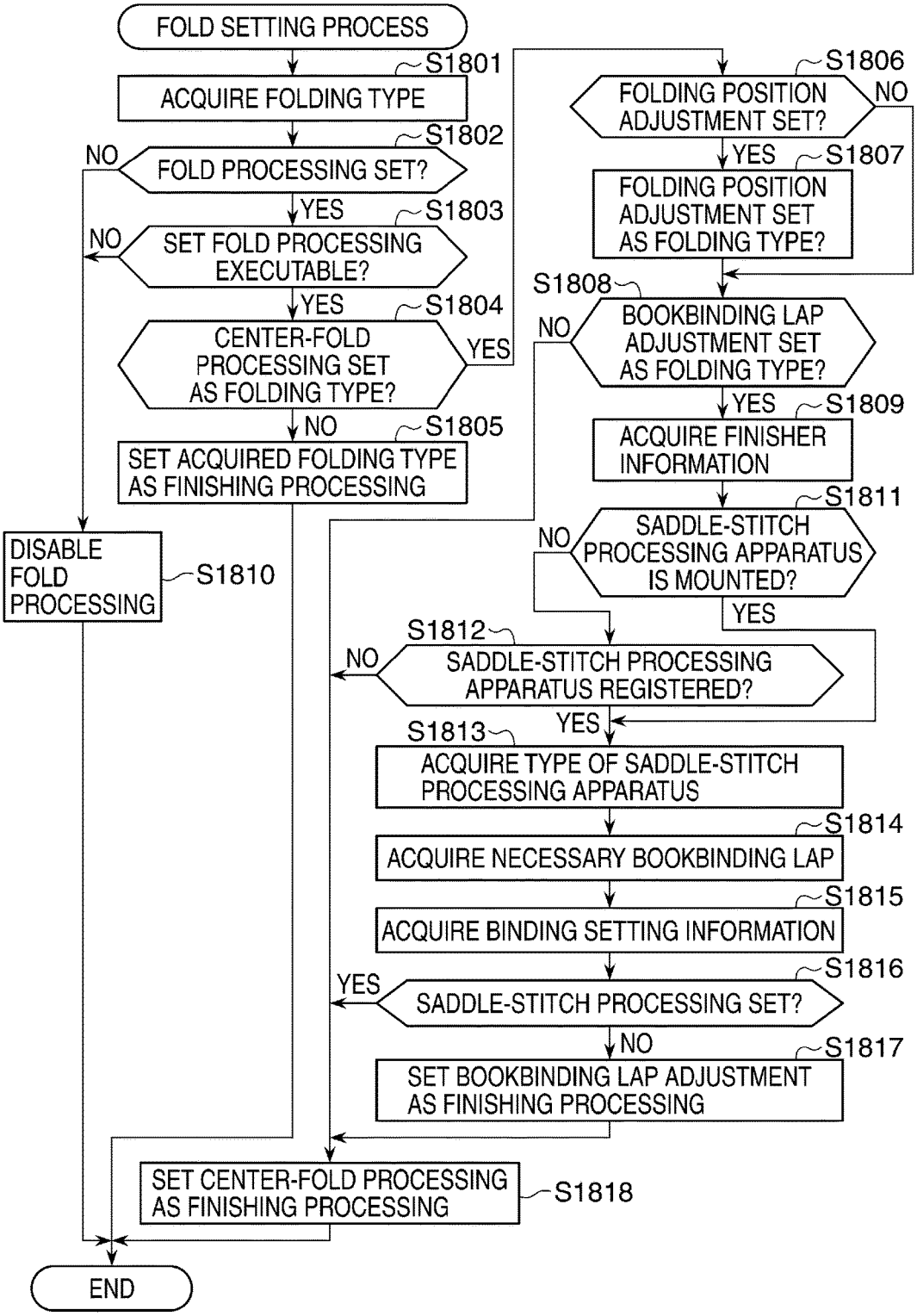
FIG. 25 is a flowchart of a fold setting process executed in the third embodiment by the CPU appearing in FIG. 8.

FIG. 25 is a flowchart of a fold setting process executed by the CPU 101 appearing in FIG. 8.

In FIG. 25, the CPU 101 acquires information of the folding type from the finishing setting information acquired in the step S901 (step S1801).

Next, the CPU 101 determines, based on the information acquired in the step S1801, whether or not the fold processing is set (step 1802).

If it is determined in the step S1802 that the fold processing is not set (NO to the step S1802), the CPU 101 disables any fold processing (step S1810), followed by terminating the present process. Note that when the present process is terminated after execution of the step S1810, the setting of the fold processing which has been temporarily stored is deleted in the step S1810, and then the present process is terminated.

On the other hand, if it is determined in the step S1802 that the fold processing is set (YES to the step S1802), the CPU 101 proceeds to a step S1803, wherein the CPU 101 determines, based on the folding type acquired in the step S1801 and the capability information of the finisher 109 acquired in the step S902, whether or not the set fold processing can be performed (step S1803).

If it is determined in the step S1803 that the set fold processing cannot be performed (NO to the step S1803), the CPU 101 proceeds to the step S1810.

On the other hand, if it is determined in the step S1803 that the set fold processing can be performed (YES to the step S1803), the CPU 101 determines whether or not center-fold processing is set as the folding type acquired in the step S1801 (step S1804).

If it is determined in the step S1804 that center-fold processing is not set (NO to the step S1804), the CPU 101 sets the folding type acquired in the step S1801 as finishing processing (step S1805), followed by terminating the present process.

On the other hand, if it is determined in the step S1804 that center-fold processing is set (YES to the step S1804), the CPU 101 determines whether or not the folding position adjustment is set as the folding type acquired in the step S1801 (step S1806). The folding position adjustment has been described in detail with reference to FIG. 10F.

If it is determined in the step S1806 that the folding position adjustment is not set as the folding type (NO to the step S1806), the CPU 101 proceeds to a step S1808.

On the other hand, if it is determined in the step S1806 that the folding position adjustment is set as the folding type (YES to the step S1806), the CPU 101 sets the folding position adjustment included in the folding type acquired in the step S1801 as finishing processing (step S1807).

Next, the CPU 101 determines whether or not the bookbinding lap adjustment is set as the folding type acquired in the step S1801 (step S1808). The bookbinding lap adjustment has been described in detail with reference to FIG. 10E.

If it is determined in the step S1808 that the bookbinding lap adjustment is not set as the folding type (NO to the step S1808), the CPU 101 sets center-fold processing as finishing processing (step S1818), followed by terminating the present process.

On the other hand, if it is determined in the step S1808 that the bookbinding lap adjustment is set as the folding type (YES to the step S1808), the CPU 101 acquires information of the finisher 109 via the accessory interface 108 (step S1809).

Next, the CPU 101 determines, based on the finisher information acquired in the step S1809, whether or not a saddle-stitch processing apparatus is mounted as the finisher 109 (step S1811).

If it is determined in the step S1811 that a saddle-stitch processing apparatus is mounted (YES to the step S1811), the CPU 101 proceeds to a step S1813. On the other hand, if it is determined in the step S1811 that no saddle-stitch processing apparatus is not mounted (NO to the step S1811), the CPU 101 determines whether or not a saddle-stitch processing apparatus has been registered according to the saddle-stitching device registration described with reference to FIG. 17 (step S1812).

If it is determined in the step S1812 that saddle-stitch processing apparatus has not been registered (NO to the step S1812), the CPU 101 proceeds to the step S1818.

On the other hand, if it is determined in the step S1812 that a saddle-stitch processing apparatus has been registered (YES to the step S1812), the process proceeds to the step S1813. The CPU 101 acquires the type of the saddle-stitch processing apparatus based on the saddle-stitch processing apparatus information acquired in the step S1809 or the registered saddle-stitch processing apparatus information (step S1813).

Next, the CPU 101 acquires the bookbinding lap required by the saddle-stitch processing apparatus corresponding to the type acquired in the step S1813 from the database connected through the network via the LAN 122 or the database included in the HDD 104 (step S1814). The step S1814 corresponds to the operation of an acquisition unit configured to acquire a bookbinding lap required by a saddle-stitch processing apparatus which performs saddle-stitch processing on fold sections created by the finisher 109.

Further, the acquisition unit acquires a bookbinding lap from the HDD 104 (storage unit) which stores the bookbinding lap associated with each saddle-stitch processing apparatus in advance as described above. Alternatively, the acquisition unit acquires a bookbinding lap from an apparatus connected via the network using the type information for identifying a saddle-stitch processing apparatus.

Then, the CPU 101 acquires the binding setting from the finishing setting information acquired in the step S901 (step S1815).

Next, the CPU 101 determines, based on the binding setting acquired in the step S1815, whether or not saddle-stitch processing is set (step S1816).

If it is determined in the step S1816 that saddle-stitch processing is set (YES to the step S1816), the CPU 101 proceeds to the step S1818.

On the other hand, if it is determined in the step S1816 that saddle-stitch processing is not set (NO to the step S1816), the CPU 101 sets the bookbinding lap acquired in the step S1814 to finishing processing (step S1817), and proceeds to the step S1818.

As described above, when a saddle-stitch processing apparatus is connected or has been registered, by acquiring a necessary amount of a lap from the type of saddle-stitch processing apparatus, it is possible to automatically set the bookbinding lap adjustment amount.

The third embodiment can be practiced in combination with the first and second embodiments. Further, the third embodiment can be executed not only for a copy job, but also similarly for a print job.

As described heretofore, according to the first to third embodiments described above, first, a bookbinding lap is set which is defined as a difference in distance from a fold line to opposite fore edge portions of each recording sheet of a fold section to be formed by forming the fold line on recording sheets having images formed thereon by the printer engine 120 (step S412). Then, the fold section is created by the finisher 109 by forming the folding line on the recording sheets according to a reference line which is shifted by the set bookbinding lap from the centerline indicative of a folding position to be formed when no lap is provided. Therefore, the bookbinding lap of a fold section can be freely set, and hence it is possible to create fold sections suitable for an apparatus which performs saddle-stitch processing on the fold sections.

As described above, according to the present embodiment, in the case where after fold sections are created by the sheet processing apparatus 90, the steps of saddle-stitch processing et seq. are executed using another system, it is possible to create a lap which is necessary for said another system to feed the fold sections. Further, images are properly printed by automatically adjusting the print position in accordance with the center-folding position, whereby it is possible to save the operator time and effort for adjusting the print position by performing test printing, and prevent unnecessary print products from being generated.

Aspects of the present invention can also be realized by a computer of a system or apparatus (or devices such as a CPU or MPU) that reads out and executes a program recorded on a memory device to perform the functions of the above-described embodiments, and by a method, the steps of which are performed by a computer of a system or apparatus by, for example, reading out and executing a program recorded on a memory device to perform the functions of the above-described embodiments. For this purpose, the program is provided to the computer for example via a network or from a recording medium of various types serving as the memory device (e.g., computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-144340, filed Jun. 27, 2012, which is hereby incorporated by reference herein in its entirety.

What is claimed is:

1. A sheet processing apparatus capable of performing folding processing on sheets, comprising:

an image forming unit configured to form an image on a sheet;

a fold unit configured to form a fold line on the sheet having the image formed thereon by the image forming unit and discharge the sheet having been folded in two along the fold line;

a storage device; and a processor configured to execute computer executable instructions recorded on the storage device, the computer executable instructions including instructions, that when executed by the processor, cause the sheet processing apparatus to:

receive a bookbinding lap and receive a folding position-adjustment amount, the bookbinding lap being received according to a first user setting through a console section and the folding position-adjustment amount being received according to a second user setting through the console section, the first user setting and the second user setting each being independently received; and control the fold unit to form the fold line at a folding position determined based on the received bookbinding lap and the received folding position-adjustment amount.

2. The sheet processing apparatus according to claim 1, wherein the processor causes the sheet processing apparatus to determine a position of the image formed on the sheet by the image forming unit based on the received bookbinding lap irrespective of the received folding position-adjustment amount, and control the image forming unit to form the image at the determined position.

3. The sheet processing apparatus according to claim 1, wherein the processor causes the sheet processing apparatus to receive a print position-adjustment amount corresponding to an adjustment amount of a position of the image formed on the sheet by the image forming unit, and controls the image forming unit to form the image at a position determined based on the received bookbinding lap and the received printing position-adjustment amount.

4. The sheet processing apparatus according to claim 3, wherein said fold unit is capable of stacking and folding a plurality of sheets, and said processor causes the sheet processing apparatus to receive a protruding amount of an inner sheet when the sheets are stacked and folded, and control the image forming unit to form the image at a position determined based on the received bookbinding lap and the received print position-adjustment amount.

5. The sheet processing apparatus according to claim 1, wherein said image forming unit forms the image at a position shifted from a centerline of the sheet.

6. The sheet processing apparatus according to claim 1, wherein an adjustment range of the bookbinding lap is greater than an adjustment range of the folding position-adjustment amount.

7. A method of controlling a sheet processing apparatus capable of performing folding processing on sheets, comprising:

forming an image on a sheet;

receiving a bookbinding lap and receiving a folding position-adjustment amount, the bookbinding lap being received according to a first user setting through a console section and the folding position-adjustment amount being received according to a second user setting through the console section, the first user setting and the second user setting each being independently received; and forming a fold line on the sheet having the image formed thereon and discharging the sheet having been folded in two along the fold line, the fold line being formed at a folding position determined based on the received bookbinding lap and the received folding position-adjustment amount.

8. A non-transitory computer-readable storage device storing a computer-executable program for causing a computer to execute a method of controlling a sheet processing apparatus capable of performing folding processing on sheets, wherein the method comprises:

forming an image on a sheet;

receiving a bookbinding lap and receiving a folding position-adjustment amount, the bookbinding lap being received according to a first user setting through a console section and the folding position-adjustment amount being received according to a second user setting through the console section, the first user setting and the second user setting each being independently received; and forming a fold line on the sheet having the image formed thereon and discharging the sheet having been folded in two along the fold line, the fold line being formed at a folding position determined based on the received bookbinding lap and the received folding position-adjustment amount.

* * * * *